United States Patent [19]

Sugden et al.

[11] Patent Number: 4,548,442

[45] Date of Patent: Oct. 22, 1985

[54] MOBILE MINING MACHINE AND METHOD

[75] Inventors: David B. Sugden, Tasmania, Australia; Bruce A. Waddell, Seattle, Wash.; James P. Kindsvater, Everett, Wash.; Robert B. Moffat, Federal Way, Wash.

[73] Assignee: The Robbins Company, Kent, Wash.

[21] Appl. No.: 558,784

[22] Filed: Dec. 6, 1983

[51] Int. Cl.[4] ..... E21C 41/00; E21C 47/00

[52] U.S. Cl. ..... 299/10; 299/31; 299/33; 299/73

[58] Field of Search ..... 299/10, 58, 48, 31, 299/33, 72, 73, 75, 77

[56] References Cited

U.S. PATENT DOCUMENTS

| | | | |
|---|---|---|---|
| 14,483 | 3/1856 | Wilson | 299/58 |
| 976,703 | 11/1910 | Seberg | 299/62 |
| 1,290,479 | 1/1919 | App | 37/190 |
| 1,769,878 | 7/1930 | Holmes | 299/48 |
| 2,695,164 | 11/1954 | Arentzen | 299/71 |
| 2,707,099 | 4/1955 | Daily | 299/75 X |
| 2,776,824 | 1/1957 | Osterhus et al. | 299/75 |
| 2,801,092 | 7/1957 | Joy | 299/10 X |
| 3,307,879 | 3/1967 | Bergmann | 299/64 |
| 3,726,562 | 4/1973 | Wharton | 299/12 |
| 3,787,101 | 1/1974 | Sugden | 175/364 X |
| 3,860,292 | 1/1975 | Bechem | 299/75 X |
| 3,873,157 | 3/1975 | Stoltefuss et al. | 299/75 X |
| 3,929,378 | 12/1975 | Frenyo et al. | 299/64 |
| 3,965,995 | 6/1976 | Sugden | 175/57 |
| 3,997,990 | 12/1976 | Satterwhite | 299/73 X |
| 4,005,905 | 2/1977 | Dubois | 299/75 X |
| 4,035,024 | 7/1977 | Fink | 299/31 |
| 4,045,088 | 8/1977 | Bechem | 299/31 |
| 4,111,488 | 9/1978 | Sigott et al. | 299/10 |
| 4,230,372 | 10/1980 | Marten | 299/39 |
| 4,231,618 | 11/1980 | Paurat | 299/33 X |
| 4,302,054 | 11/1981 | Haskew et al. | 299/75 X |
| 4,312,541 | 1/1982 | Spurgeon | 299/31 |
| 4,379,594 | 4/1983 | Zitz et al. | 299/10 |
| 4,381,038 | 4/1983 | Sugden | 175/344 |

OTHER PUBLICATIONS

Anderson Strathclyde Limited advertisement, *Tunnels & Tunnelling*, vol. 11, No. 3, Apr. 1979, p. 29.

Stack, B., *Handbook of Mining and Tunnelling Machinery*, Chichester, John Wiley & Sons, 1982, pp. 147, 148, 183, 193–195.

*Primary Examiner*—Stephen J. Novosad
*Assistant Examiner*—Thuy M. Bui
*Attorney, Agent, or Firm*—Graybeal & Cullom

[57] ABSTRACT

A first mobile mining machine for cutting mining tunnels in hard rock, which includes a horizontally swinging wheel-like cutterhead assembly mounted on a crawler and base frame assembly. The cutterhead assembly consists of a transverse horizontal axis wheel-like drum on which are multiple peripherally mounted rolling cutter units.

A second mobile mining machine for cutting mining tunnels in hard rock, which includes a horizontally swinging and vertically ranging wheel-like cutterhead assembly mounted on a crawler and base frame assembly. The cutterhead assembly consists of a transverse horizontal axis wheel-like drum on which are multiple peripherally mounted rolling cutter units.

A method of cutting mining tunnels in hard rock which includes the steps of providing a wheel-like cutterhead assembly for cutting the hard rock, rotating the cutterhead assembly about its horizontal axis, plunging the rotating cutterhead forward into the hard rock, sweeping the rotating cutterhead assembly sideward in a first horizontal direction through the hard rock, plunging the rotating cutterhead forward into the hard rock, then sweeping the rotating cutterhead sideward in the other horizontal direction, and then repeating the last four steps.

45 Claims, 14 Drawing Figures

MOBILE MINING MACHINE AND METHOD

BACKGROUND OF THE INVENTION (1) Field of the Invention

The invention is in the field of mine tunneling machines and methods, such as machines and methods for cutting large variable cross-section mining tunnels in hard rock.

(2) Description of the Prior Art

The most common prior art method of forming large mining tunnels in hard rock (defined as rock having a compressive strength of above 15,000 psi) is the drill-and-blast method using explosives which has many disadvantages, one of which is that it is very hazardous. Thus, there has been a long-felt need for a mobile mining machine capable of successfully cutting large mining tunnels in hard rock by mechanical means in order to replace the use of explosives. Such a machine should also be portable, that is, capable of being disassembled into components which are sufficiently small and light in weight that they may be transported in vertical mine shaft elevators.

The conventional roadheader mining machines are frequently used in horizontal mining work when the rock is soft (defined as rock having a compressive strength less than 15,000 psi), but in hard rock the cutting picks in the roadheaders are incapable of successful operation. The drill-and-blast method must then be employed.

Several prior art patents show mining machines which appear to be capable of rotating a cutterhead about a horizontal axis and swinging it across a work face about a vertical axis. Typical of these are Osterhus et al U.S. Pat. No. 2,776,824, Bergmann U.S. Pat. No. 3,307,879, Frenyo et al U.S. Pat. No. 3,929,378, Sigott et al U.S. Pat. No. 4,111,488, and Marten U.S. Pat. No. 4,230,372. All of these prior art patents disclose machines employing toothed or ripper cutter elements rather than disk cutters.

The prior art also includes Wharton U.S. Pat. No. 3,726,562 which discloses a coal mining machine having a cutterhead constructed in the shape of a shallow cone and rotatably mounted on the forward end of an elongate boom. The cutterhead, although not described in detail, appears to involve a series of picks as the cutting elements. It is not clear from the disclosure of the patent how the cutterhead is rotated and the patent disclosure does not contemplate any particular correlation between the rate of cutterhead rotation and the rate of cutterhead swing. The cutterhead is swingable both horizontally and vertically.

Stoltefuss et al U.S. Pat. No. 3,873,157 discloses a tunneling or mining machine with the cutting device rotatably mounted on the forward end of a boom which is vertically and horizontally pivotable. The cutting arrangement involves two narrow wheels or rollers carrying pick-like cutters.

Bechem U.S. Pat. No. 4,045,088 discloses a mining machine which is characterized by oscillation of a so-called drilling head about a vertical pivot axis to arcuately drive a slot cavity, the head and the rotatable disc cutters carried thereby being oscillated through a horizontal angle of about 120°. Plural disc cutters are canted in a diverging manner. No cutter movement is contemplated other than horizontal oscillation.

Finally, Spurgeon U.S. Pat. No. 4,312,541 discloses a trench cutting machine comprising a main body assembly and a cutting wheel assembly. This coal mining machine moves plural rows of disk cutters horizontally about a substantially vertical axis to facilitate discharge to a conveyor. A cylinder is mounted transversely on the main body assembly and carries a pair of pistons which extend axially from each end of the cylinder. Pads are provided on each piston to bear against the side walls of the trench. Each piston has an end face within the cylinder which, together with an inner side wall of the cylinder, comprises a pressure chamber adapted to force the pads against the trench. The main body and its cylinder are free to move laterally relative to the pistons when the cylinder is pressurized. Extensible arms are provided between the pistons and the main body assembly for forcing the main body assembly and its cutting wheel forwardly to progressively cut a trench. A steering assembly is provided to shift the main body assembly laterally relative to the pistons and about the central axis of the cutting wheel.

SUMMARY OF THE INVENTION

The first embodiment of the invention is a mobile mining machine for cutting mining tunnels in hard rock by horizontal sweeping movements. The machine includes a wheel-like cutterhead assembly having a substantially horizontal axis of rotation and multiple peripherally mounted rolling cutter units. Motors are provided for rotating the cutterhead assembly about its horizontal axis. A boom assembly supports the cutterhead assembly. A boom carriage is provided for supporting the boom assembly. Hydraulic cylinders are mounted on the boom carriage for sweeping the boom assembly and the cutterhead assembly horizontally from side to side. A base frame is provided for slidably supporting the boom carriage. A thrust cylinder is mounted on the base frame for thrusting forward the boom carriage, the boom assembly, and the cutterhead assembly. Hydraulic gripper cylinders are mounted on the base frame for holding the base frame stationary when the thrust cylinder is thrusting the boom carriage forward and when the sweep cylinders are sweeping the cutterhead assembly from side to side. Crawlers are provided for moving the base frame.

The second embodiment of the invention is a mobile mining machine for cutting mining tunnels in hard rock by horizontal sweeping movements and vertical ranging movements. A wheel-like cutterhead assembly for cutting hard rock is provided, the cutterhead assembly having a substantially horizontal axis of rotation and multiple peripherally mounted rolling cutter units. Motors are provided for rotating the cutterhead assembly about its horizontal axis. An outer boom assembly supports the cutterhead assembly. An inner boom assembly provides support for the outer boom assembly. Hydraulic cylinders are mounted on the inner boom assembly for sweeping the outer boom assembly and the cutterhead assembly horizontally from side to side. A boom carriage supports the inner boom assembly. Hydraulic cylinders are mounted on the boom carriage for lifting the inner boom assembly vertically. A base frame is provided for slidably supporting the boom carriage. Hydraulic thrust cylinders are mounted on the base frame for thrusting forward the boom carriage, the inner boom assembly, the outer boom assembly, and the cutterhead assembly. Hydraulic gripper cylinders are mounted on the base frame for holding the base frame stationary when the thrust cylinders are thrusting forward the boom carriage and when the sweep cylinders are sweeping the outer boom and the cutterhead assembly from side to side. Crawlers are provided for moving the base frame.

Another embodiment of the invention is a method of cutting mining tunnels in hard rock using the following steps. First, providing a wheel-like cutterhead assembly for cutting the hard rock, the cutterhead assembly having a substantially horizontal axis of rotation and having multiple peripherally mounted rolling cutter units each rotatable about its own axis. Second, while rotating the cutterhead assembly about its substantially horizontal axis, plunging the rotating cutterhead assembly forward into the hard rock work face. Third, while rotating the cutterhead assembly about its substantially horizontal axis, sweeping the rotating cutterhead assembly across the hard rock work face, the rolling cutter units on the cutterhead assembly being rotated about their respective axes by contact with the work face and making a substantially helical cut in the work face in the course of transiting the work face, such sweeping action and cutterhead assembly rotation continuing until the cutterhead assembly has transited completely across the work face. Fourth, while rotating the cutterhead assembly about its substantially horizontal axis, plunging the rotating cutterhead assembly forward into the hard rock work face. Fifth, while rotating the cutterhead assembly about its substantially horizontal axis, sweeping the rotating cutterhead assembly back across the hard rock work face, such sweeping action and cutterhead assembly rotation continuing until the rotating cutterhead assembly has transited completely across the hard rock work face. Sixth, repeating the last four steps.

Another embodiment of the invention is a method of cutting mining tunnels in hard rock using the following steps. First, providing a wheel-like cutterhead assembly for cutting the hard rock, the cutterhead assembly having a substantially horizontal axis of rotation and having multiple peripherally mounted rolling cutter units each rotatable about its own axis. Second, while rotating the cutterhead assembly about its substantially horizontal axis, plunging the rotating cutterhead assembly forward into the hard rock work face. Third, while rotating the cutterhead assembly about its substantially horizontal axis, sweeping the rotating cutterhead assembly across the hard rock work face, the rolling cutter units on the cutterhead assembly being rotated about their respective axes by contact with the work face and making a substantially helical cut in the work face in the course of transiting the work face, such sweeping action and cutterhead assembly rotation continuing until the cutterhead assembly is transited completely across the work face. Fourth, while rotating the cutterhead assembly about its substantially horizontal axis, plunging the rotating cutterhead assembly forward into the hard rock work face. Fifth, stopping the rotation of the cutterhead assembly and then rotating the cutterhead assembly in the reverse direction of rotation. Sixth, while rotating the cutterhead assembly about its substantially horizontal axis, sweeping the rotating cutterhead assembly back across the hard rock work face, such sweeping action and cutterhead assembly rotation continuing until the rotating cutterhead assembly has transited completely across the hard rock work face. Seventh, repeating the last three steps.

Description of the Preferred Embodiments

The First Embodiment

Figure 1:
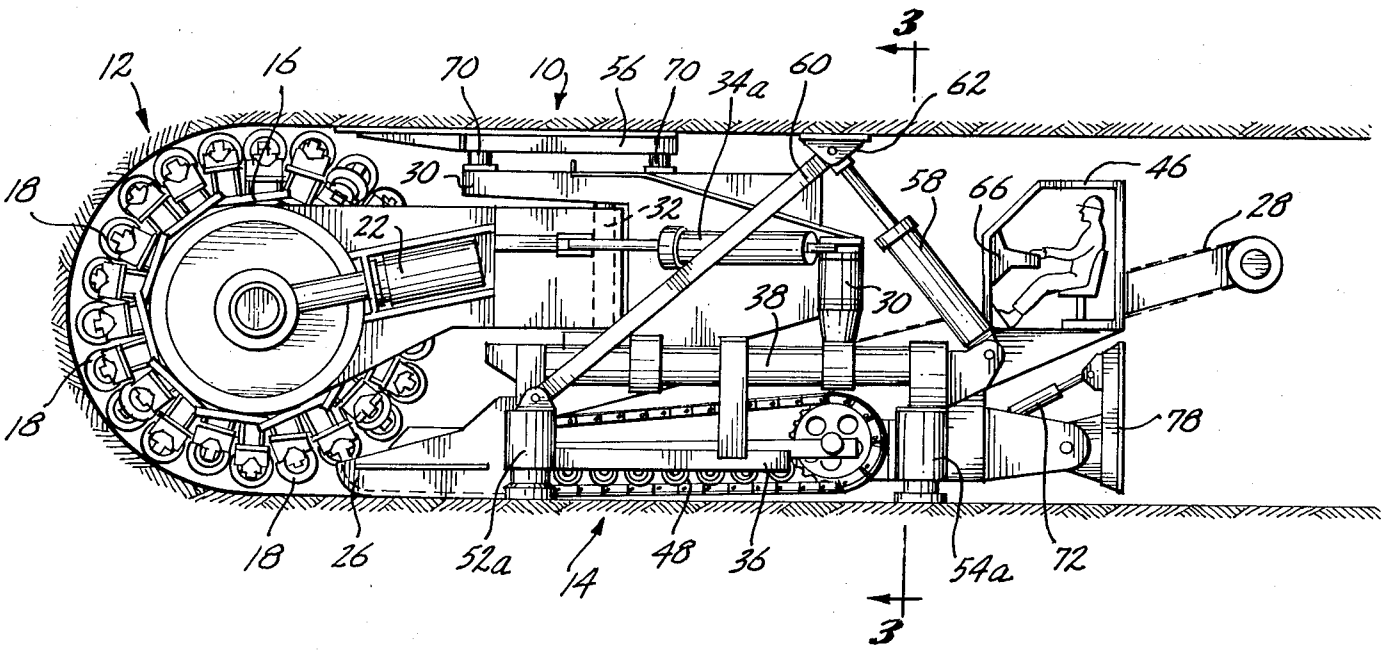
FIG. 1 is a side elevational view of the first embodiment of a mobile mining machine constructed in accordance with the principles of the present invention.

Referring to FIGS. 1–4 and 10, the first embodiment of the invention is the mobile mining machine 10 which includes a horizontally swinging wheel-like cutterhead assembly 12 mounted on a crawler and base frame assembly 14. It is capable of producing substantially rectangular mining tunnels of variable width in hard rock.

The cutterhead assembly 12 (FIGS. 1 and 10) consists of a transverse horizontal axis wheel-like drum 16 on which are peripherally mounted a plurality of rolling cutter units 18. These are preferably hard rock rolling disc cutters about 10 to 18 inches in diameter of the general type disclosed in Sugden U.S. Pat. No. 3,787,101 issued Jan. 22, 1974. Alternatively, the rolling cutter units 18 may be rolling button cutters of the general type disclosed in Sugden U.S. Pat. No. 4,381,038 issued Apr. 26, 1983. The drum 16 contains two large tapered roller bearings which accept and transmit the cutting forces through a dead shaft arrangement to the boom assembly 20. Speed reduction gearing consisting of two bevel gear sets driving into two double compound planetary gear trains are contained in a sealed cavity within the drum 16. Each gear reducer set is driven by a 150 kW (200 HP) water-cooled electric drive motor 22.

The cutterhead assembly 12 generates the work face profile by plunging forward and then swinging alternately left and right. The cutterhead assembly 12 is equipped with scrapers 24 (FIG. 2) which move the muck up the muck apron 26 onto the conveyor 28.

The boom assembly 20 is a plate girder structure to which the cutterhead assembly 12 is attached. The aft end of the boom assembly 20 is connected to a boom carriage assembly 30 by a vertical boom swing axis pin 32 (FIG. 1).

The hydraulic boom swing cylinders 34, on either side of the vertical axis pin 32, are attached to the boom assembly 20 and the boom carriage assembly 30, thereby providing the torque required to swing the cutterhead assembly 12 horizontally. The cutting forces are transmitted by the boom assembly 20 through the vertical axis pin 32 and the boom swing cylinders 34 to the boom carriage assembly 30.

The boom carriage assembly 30 is a box-shaped structure which provides a mounting surface for the boom assembly 20 and transmits the cutting forces to the base frame 36. The boom carriage assembly 30 is supported on two cylindrical ways 38 attached to the base frame 36. The boom carriage assembly 30 slides in a fore-aft direction on the cylindrical ways 38. The hydraulic thrust cylinder 40 (FIG. 3) connected to the boom carriage assembly 30 and the base frame 36 provides the cutterhead plunging action and transfers the cutterhead thrust reaction to the base frame 36.

The base frame assembly 36 also provides mounting surfaces for the hydraulic power unit 42 (FIG. 2), the hydraulic reservoir 44 (FIG. 2), the electrical system components, the operator's cab 46, and other miscellaneous equipment.

The crawler and base frame assembly 14 consists of the base frame 36 supported on caterpillar type crawler tracks 48 and 50. The forward end of the base frame 36 supports the muck apron 26 and a set of four jacking pads, the two front jacks 52*a*, 52*b* and the two rear jacks 54*a*, 54*b*, which support the machine 10 during the boring cycle. The forces generated by the roof gripper assembly are distributed to the jacking pads 52*a*, 52*b*, 54*a*, 54*b* by the base frame 36.

Figure 4:
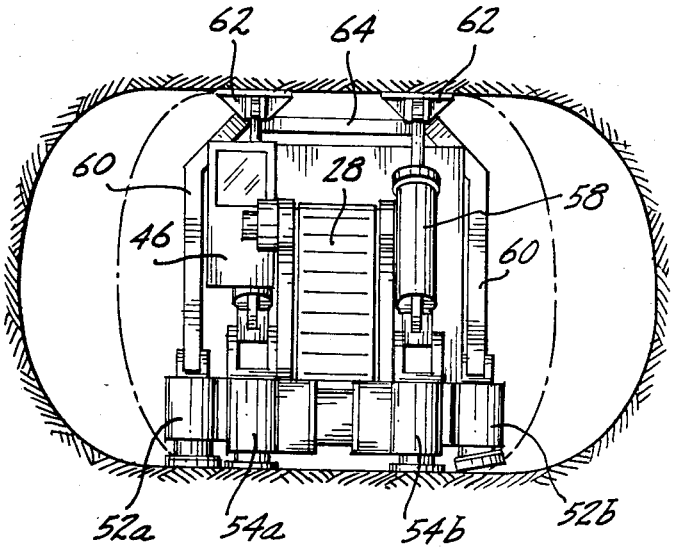
FIG. 4 is a rear view of the mobile mining machine illustrated in FIG. 1.

The roof gripper assembly consists of two hydraulic gripper cylinders 58, two swing links 60, two shoes 62, and transverse stabilizing member 64 (FIG. 4). The roof gripper assembly is designed to maintain full roof contact of the shoes 62 independently of the machine attitude. The gripper reaction augments the dead weight reaction forces on the jacking pads 52*a*, 52*b*, 54*a*, and 54*b*, thus ensuring stability during the boring cycle.

The roof support 56 is raised and lowered by the roof support cylinders 70.

The muck handling system comprises the front muck apron 26 and the conveyor 28. The muck apron 26 serves the dual function of scraping the invert and directing muck from the cutterhead scrapers 24 to the conveyor 28.

The conveyor way has the capacity to accept a belt or a chain type conveyor. The machine as shown has a 30 inch (750 mm) belt conveyor but a chain type may be substituted in the event of blocky ground.

The electrical system, which is conventional per se, includes the operator's control console 66 located in the operator's cab 46. Incoming three-phase voltage to the machine is 950 volts r.m.s. so that the size of the trailing cables is kept to a minimum. Rated power at full load is 470 kVa.

The two 200 H.P. electric drive motors 22, the hydraulic pump motors 42 (FIG. 2), and the lubrication motors are started by full voltage across the line starters. The motor voltage is the same as the incoming voltage. Motor control voltage, earth leakage, and ground continuity checks are conventional.

A conventional reversing circuit breaker for the drive motors 22 allows a manual means of reversing the cutterhead 12 when jammed. Motors start one at a time by a time delay relay. Auxiliary loads include a 5 kVa lighting panel, a 70 amp welding receptacle, and drive motor trickle heat.

The operator's console 66 comprises conventional ammeters for the drive motors 22 and the hydraulic pump motors 42. Indicating pilot lights assist in troubleshooting and provide visual warning in event of trouble. All motors are started at the operator's console 66 by conventional selector switches.

A meter relay sensing the electric current going to the two drive motors 22 serves to de-energize the swing solenoid valves if the motors exceed a preset overload current. The swing resumes when the load level drops to a preset level.

The hydraulic system consists of two electrical motors 42 (rated at 75 and 25 H.P.) driving the hydraulic pumps, the 150 gallon (568 liter) hydraulic tank 44, and the required filters, control valves, cylinders, and hydraulic motors. Closed loop circuits and piston pumps are used for the major functions in this system. They provide better control, longer life, and higher efficiency.

Figure 5A:
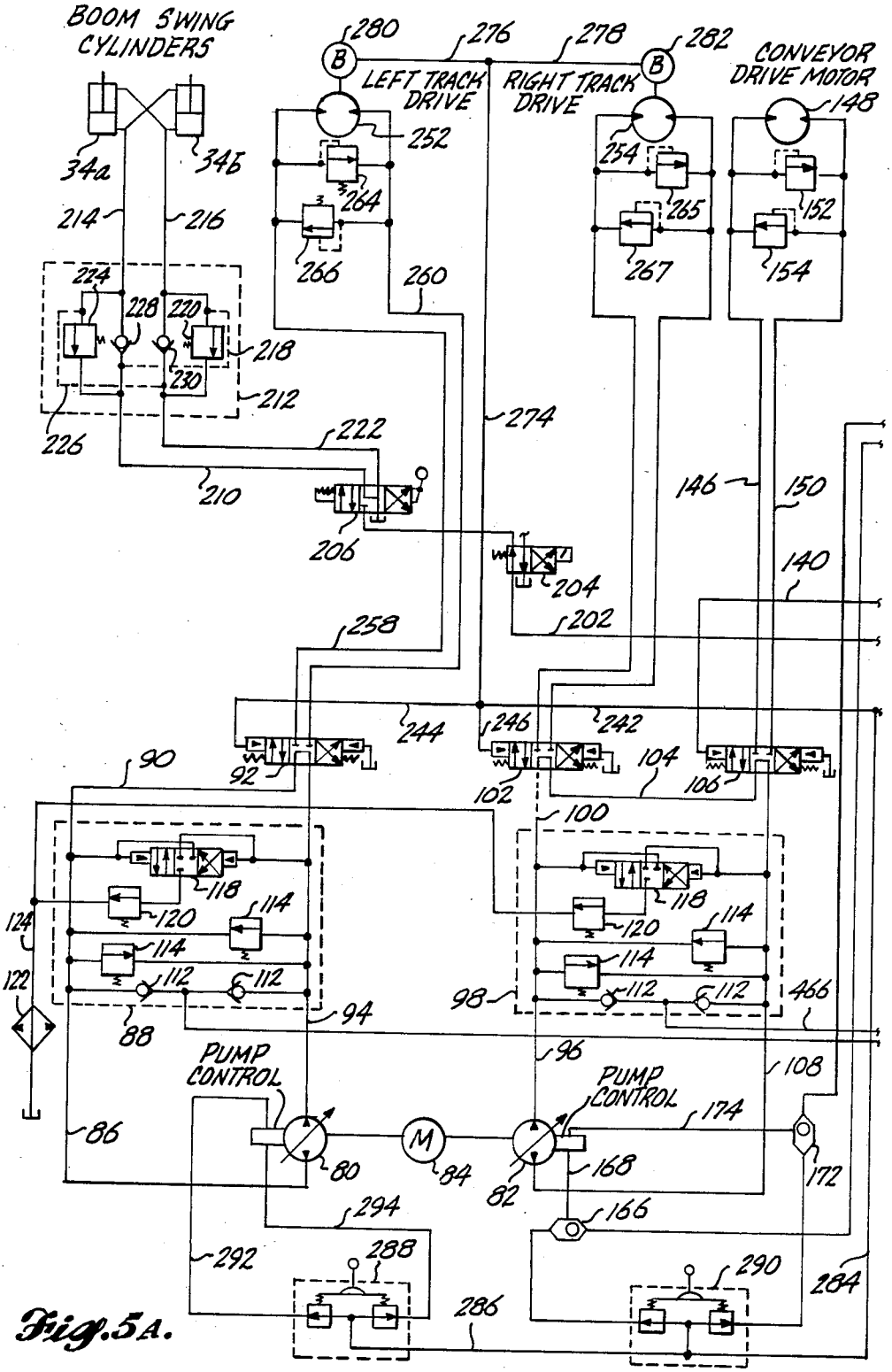
FIGS. 5A, 5B, and 5C are a schematic representation of the hydraulic control system for the mobile mining machine illustrated in FIG. 1.

The boom swing hydraulic cylinders 34 traverse the boom assembly 20 and the cutterhead assembly 12 from one side to the other. The swing cylinders are powered by pressure compensated pump 128 (FIG. 5C) through flow control valve 200 (FIG. 5B) and swing solenoid valve 204 (FIG. 5A). Swing direction is selected by manual control valve 206 (FIG. 5A). Motion control valve 212 (FIG. 5A) limits boom swing overspeed.

The muck conveyor 28 is driven by a hydraulic motor and gear reducer. The hydraulic motor is powered by a variable volume piston pump in a closed loop circuit. The pump has a built-in horsepower limiter. A separate charge pump and necessary valving are provided for loop cooling. Cross line relief valves and reverse flow filters provide system protection. Variable speed adjustment is provided by remote hydraulic pilot pressure control.

The hydraulic trammming motors drive the left and right crawler tracks 48 and 50, respectively, using the two pumps and circuits described above. A manual pilot valve 136 (FIG. 5) selects either the boring mode, in which the pumps drive the conveyor 28, or the tramming mode, in which the pumps drive the tramming motors. Tramming is controlled by two joystick controls, one for the left crawler 48 and one for the right crawler 50. These allow variable speed control in both forward and reverse directions.

The thrust cylinder 40 (FIG. 3) is attached to the sliding boom carriage assembly 30 and to the base frame 36. As the thrust cylinder 40 extends, the boom carriage assembly 30 is pushed forward which plunges the cutterhead 12 into the rock face. The thrust cylinder 40 is powered by pressure compensated pump 128 (FIG. 5C) through flow control valve 424 (FIG. 5C). Extension or retraction is selected by means of manual control valve 420 (FIG. 5C). A scale mounted on the base frame 36 shows the plunge position of the boom carriage assembly 30 to the operator. Alternatively, there may be two thrust cylinders mounted higher on the machine. Two thrust cylinders are shown in the hydraulic system schematic (FIG. 5C).

The floor jacks 52 and 54, the swing cylinders, and the crowd plate lift cylinder 72 are all powered by the same pump 128 (FIG. 5) as the thrust cylinder 40 and are controlled by manual valves. Pilot check valves are used to ensure zero leakage in these circuits.

The dust suppression system consists of a full width shield 74 (FIG. 2) located just aft of the boom swing axis pin 32. It is intended that the cavity formed by this shield 74 and the rock heading be maintained in a negative pressure condition.

Flow from this cavity is directed through a scrubber (not shown) and discharged to the tunnel of a vent line. In addition, atomizing spray nozzles (not shown) are located at critical dust generation points such as the cutterhead assembly 12 and the conveyor discharge.

The operator's cab 46 is suitably located on the left rear side of the machine 10 and is a robust steel cage structure. All of the machine controls are available to the operator on console 66 in the cab. The operator's position is one of maximum visibility and safety.

Figure 2:
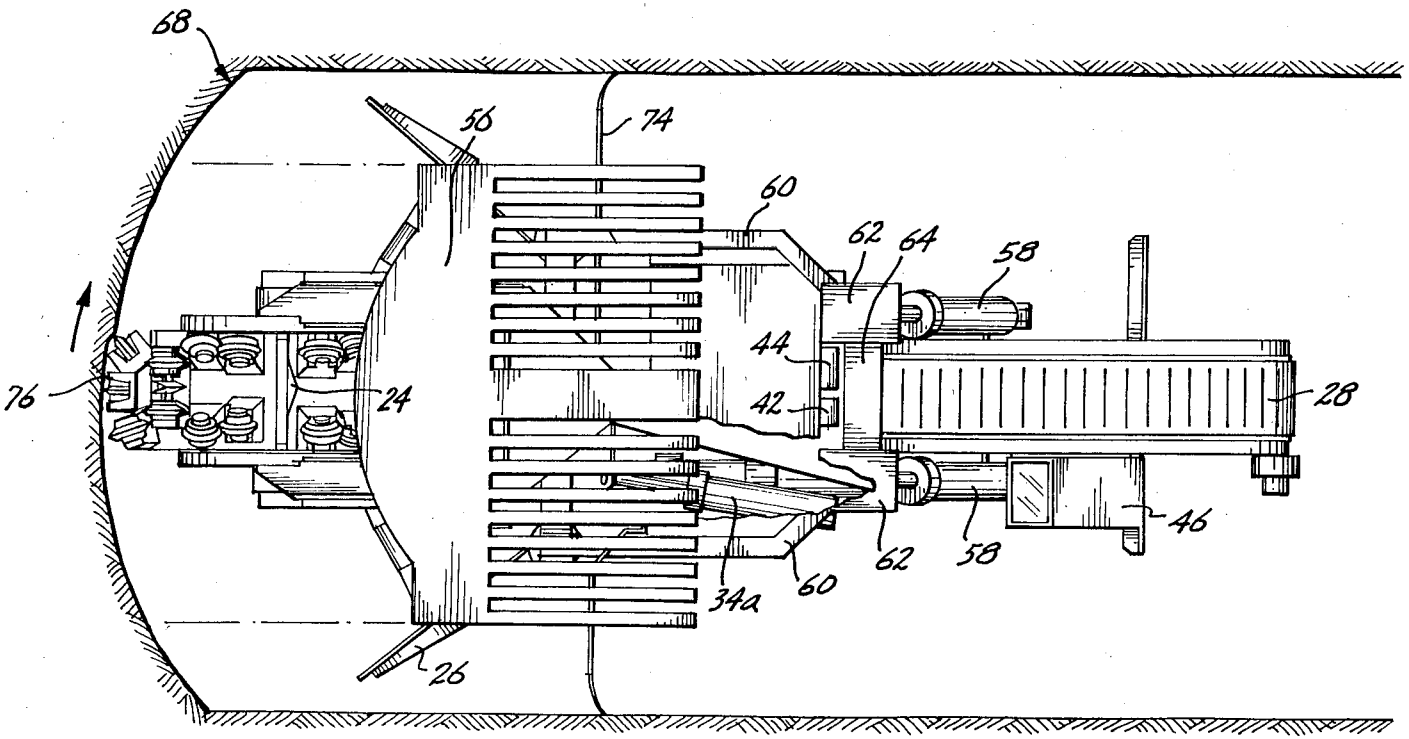
FIG. 2 is a top view partially in section of the mobile mining machine illustrated in FIG. 1.
Figure 3:
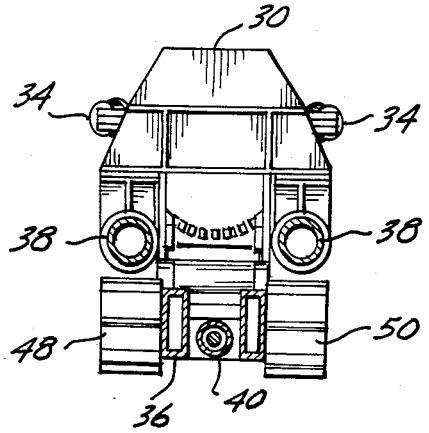
FIG. 3 is a cross-sectional view of the mobile mining machine illustrated in FIG. 1, taken along line 3—3 thereof.

The operation sequence is as follows. As shown in FIG. 2, the machine 10 has just finished retracting the thrust cylinder 40 and is ready to begin mining. The operator activates the cutterhead drive motors 22 and begins a right hand mining swing. The rolling cutter units 18 on the rotating cutterhead assembly 12 are rotated about their respective axes by contact with the work face and they make substantially helical cuts in the work face in the course of transiting across it. At the end of the right swing, the operator activates the thrust cylinder 40 and plunges the rotating cutterhead assembly 12 forward into the rock work face 68 a distance of about 0.1 to 4 inches. The plunge rate may be about 1 to 10 inches per minute depending on the rock conditions. Plunge depth and swing rate are adjusted according to the rock hardness and cutability. A left hand mining swing is then begun and completed across the work face. The plunge and swing cycle is repeated until the total advance stroke of 30 inches (750 mm) of the thrust cylinder 40 is exhausted. The rotation of the cutterhead assembly 12 is stopped on the last swing at work face midpoint 76 (FIG. 2) and the cutterhead drive motors 22 are shut off.

To advance the crawler tracks 48 and 50, the roof gripper cylinders 58 are first retracted and then the rear support jacks 54 are retracted. The forward jacks 52 are then retracted lowering the crawler tracks 48 and 50 to the floor. The operator then activates the tracks 48 and 50, moving the base frame 36 forward and retracting the thrust cylinder 40. As the base frame 36 advances, the operator can adjust the axis of the base frame for the tunnel line by steering the crawler tracks 48 and 50. When the base frame 36 reaches its forward position, the crawlers 48 and 50 are deactivated and the forward jacks 52 are extended. As the machine 10 raises to grade, roll attitude may be set by varying the amount of extension of the forward jacks 52. The rear jacks 54 are then extended and the gripper shoes 62 extended to the roof to lock the base frame 36 in the tunnel. The cutterhead drive motors 22 are then activated and mining can begin again.

An alternative mode of operation is as follows. As shown in FIG. 2, the machine 10 has just finished retracting the thrust cylinder 40 and is ready to begin mining. The operator activates the cutterhead drive motors 22 and begins a right hand mining swing. At the end of the right hand swing, the operator activates the thrust cylinder 40 and plunges the rotating cutterhead assembly 12 forward into the rock face 68 a distance of about 0.1 to 4 inches. The plunge rate may be about 1 to 10 inches per minute depending on the rock conditions. Plunge and swing rate are adjusted according to the rock hardness and cutability. The rotation of the cutterhead assembly 12 is stopped. Then the cutterhead assembly 12 is rotated in the reverse direction of rotation. A left hand mining swing is then begun and completed across the work face. By reversing the direction of rotation of the cutterhead assembly 12, the rolling cutter units 18 track across the work face in essentially the same substantially helical cuts they made during the previous sweep. The plunge, stop rotation, reverse rotation, and swing cycle is repeated until the total advance stroke of 30 inches (750 mm) of the thrust cylinder 40 is exhausted. The rotation of the cutterhead assembly 12 is stopped on the last swing at work face midpoint 76 and the cutterhead drive motors 22 are shut off. The crawler tracks would then be advanced as described above.

As noted above, steering corrections for tunnel line and grade are made during the crawler advance cycle. If a horizontal curve is desired, the operator can incrementally deviate from the straight tunnel line during the crawler advance cycle using turnout offsets. Vertical curves are accomplished by setting the machine on grade as noted above, starting the cutterhead assembly 12 and then extending or retracting the rear support jacks 54 during the boring cycle.

To make a turnout or crosscut, the operator can release the swing limit locks, thus allowing the boom 20 to swing further to one side. By using the swing extreme of one side of the tunnel and then cocking the machine at an angle to the tunnel centerline during crawler advance, a short radius turnout or crosscut may be accomplished.

The amount of wear allowable on the disc cutters 18 is greater than on a conventional tunnel boring machine due to the easy access to the cutterhead assembly 12 and the ability to adjust the swing width.

To change the disc cutters 18, the machine 10 is backed away from the rock face 68 and the disc cutters 18 are changed from the front of the cutterhead assembly 12. If bad ground is encountered, the disc cutters 18 can be changed from behind the cutterhead assembly 12 under the protection of the boom 20. Two men can change the disc cutters 18, each disc cutter requiring approximately thirty minutes to change.

Figure 5B:
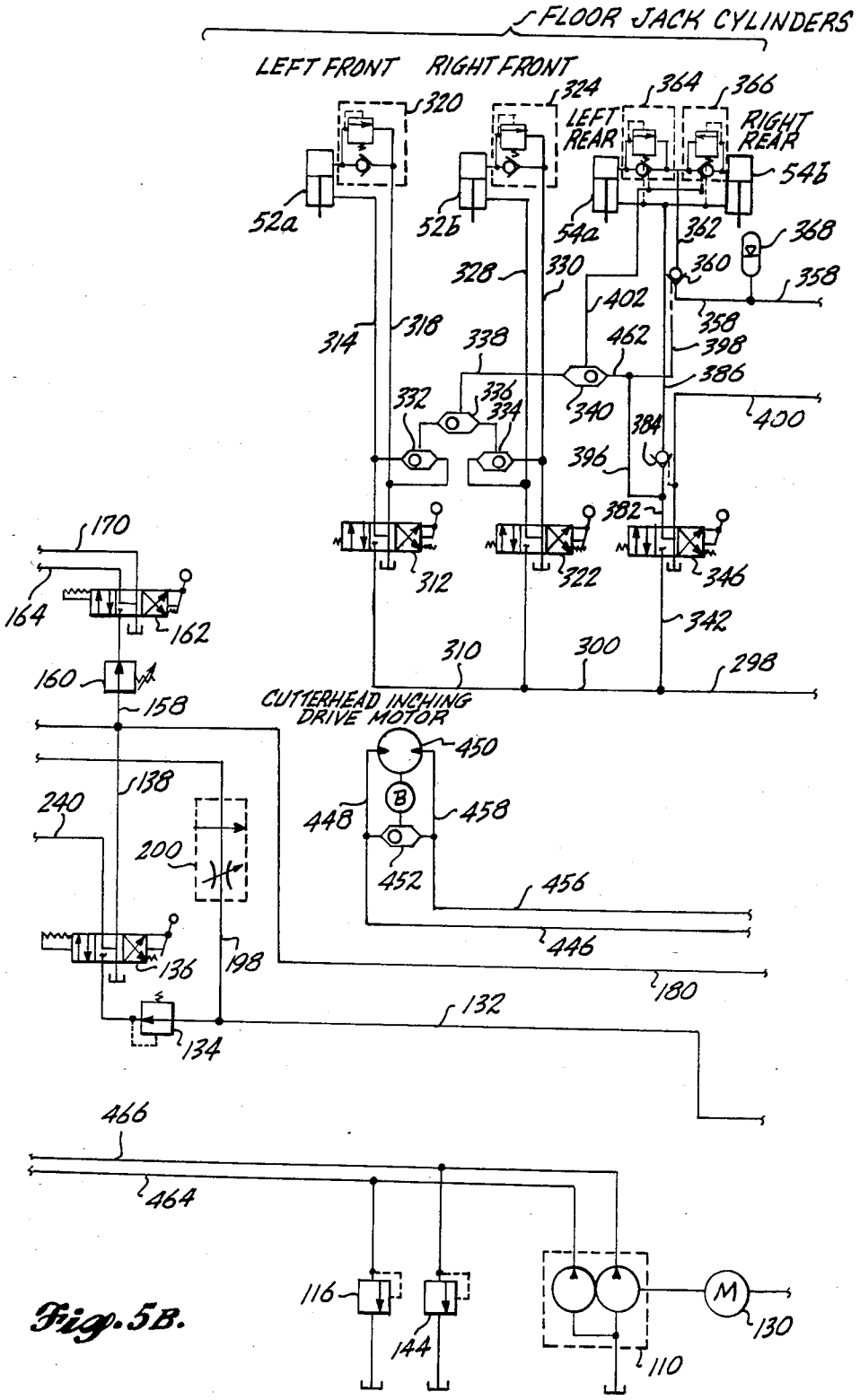
Figure 5C:
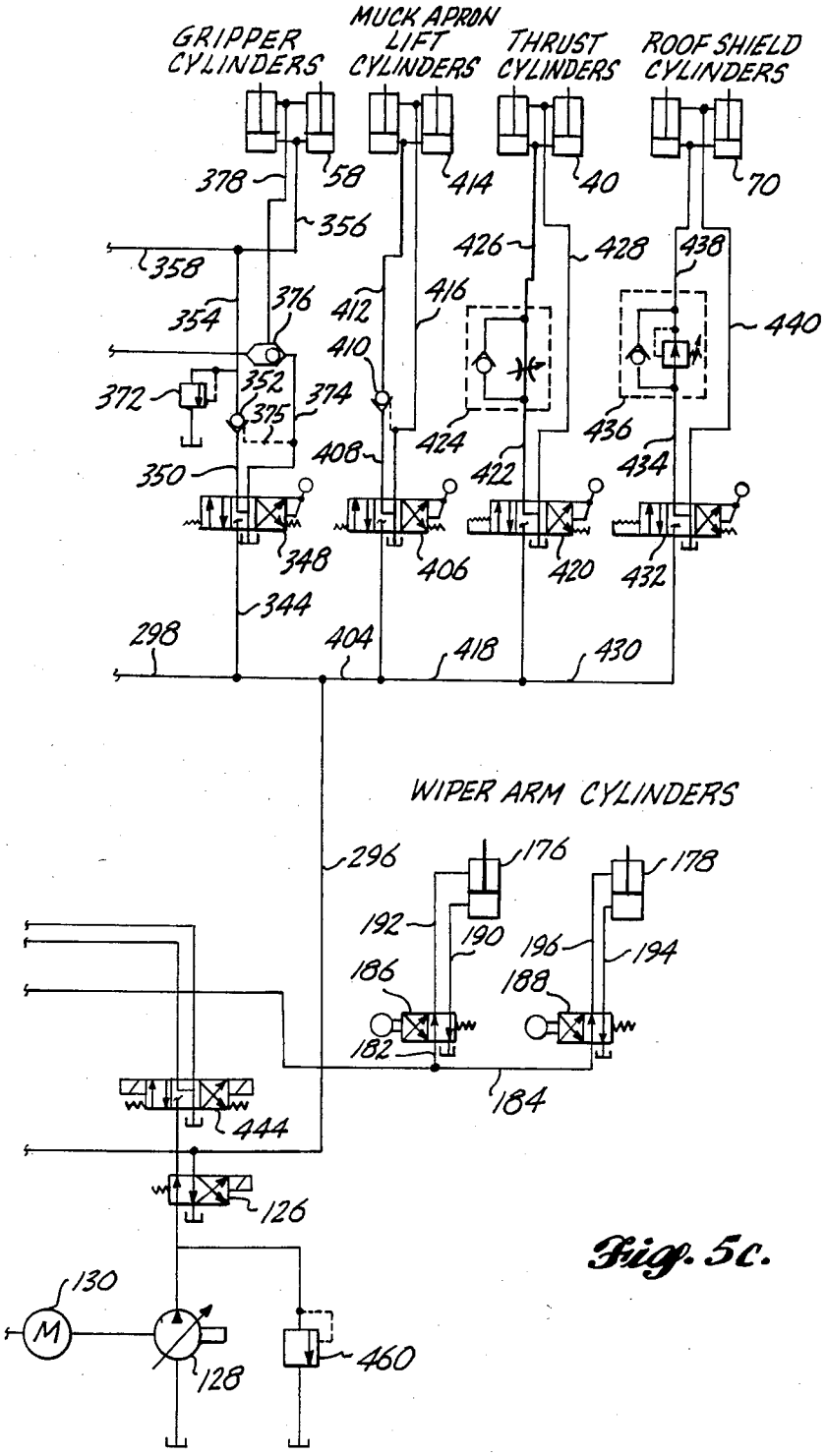

FIGS. 5A, 5B, and 5C are a simplified schematic representation of the hydraulic control system for the mobile mining machine 10. Pumps 80 and 82 are bidirectional hydrostatic pumps whose flow and pumping direction are controlled by pressure signals applied to their respective control ports. They are both driven by an electric motor 84. With all control valves in neutral, oil flows from pump 80 through line 86, valve 88, line 90 and valve 92 and returns through line 94 to pump 80.

In a similar manner, oil flows from pump 82 through line 96, valve 98, line 100, valve 102, line 104, valve 106 and returns through line 108 to pump 82. The left section of makeup pump 110 supplies oil to hydrostatic valve 88. Oil flows through either of the two check valves 112 to the low pressure side of the loop. Relief valves 114 limit maximum loop pressure. Makeup oil pressure is limited by relief valve 116. Shuttle valve 118 directs oil from the low pressure side of the loop through relief valve 120 to oil cooler 122 via line 124 and from there to tank. In a similar manner, valve 98 circulates the oil from the pump 82 loop.

To activate the boom swing cylinders **34*a* and 34*b* and the conveyor 28, first, solenoid valve 126 must be shifted to the left. Oil then flows from pump 128 through valve 126, line 132 and pressure reducing valve 134 to selector valve 136. If selector valve 136 is shifted to the left, oil flows through lines 138, 140 to shift valve 106 to the right. Pump 82 loop oil now flows through valve 106 and line 146 to the conveyor drive motor 148. Oil returns to the loop from motor 148 through line 150 and valve 106. Relief valves 152 and 154** limit loop pressure during emergency stops.

To control the conveyor speed and direction, oil flows from selector valve 136 through lines 138 and 158 to pressure reducing valve 160. From valve 160, oil flows to conveyor selector valve 162. If selector valve 162 is shifted to the right, oil then flows through line 164, shuttle valve 166 and line 168 to one of the pump 82 control ports thus directing the pump 82 to circulate loop oil in one direction. If selector valve 162 is shifted to the left, oil flows through line 170, shuttle valve 172 and line 174 to the other pump 82 control port thus directing the pump to circulate oil in the opposite direction in the loop. Pump volume is regulated by adjusting pressure reducing valve 160.

With selector valve 136 shifted to the left, the wiper arm cylinders 176 and 178 are also activated. Oil flows from valve 136 through lines 138, 180, 182, and 184 to valves 186 and 188. Valves 186 and 188 are alternately activated by a cam plate mounted on the boom 20. When the boom 20 reaches a certain location on the left, a cam shifts valve 186 to the right. Oil flows through valve 186 and line 190 to extend cylinder 176. Oil flows out of cylinder 176 through line 192 and valve 186 to the tank. As the boom 20 swings back toward the right, the cam retracts returning valve 186 to its original position. Oil now flows through valve 186 and line 192 to retract cylinder 176. When the boom 20 reaches a certain location on the right, a cam shifts valve 188 to the right extending cylinder 178 in a similar manner.

To activate the boom swing cylinders 34*a* and 34*b*, oil flows through valve 126, lines 132 and 198 to flow control valve 200 which regulates the speed of the boom swing. From valve 200, oil flows through line 202 and valve 204 to swing direction selector valve 206. Valve 204 is a solenoid actuated directional valve which stops the boom swing if a cutterhead overload is sensed by the electrical system. If the swing selector valve 206 is shifted to the right, oil flows through line 210, valve 212, and line 214 to the boom swing cylinders 34*a* and 34*b*. The boom 20 is restricted from swinging ahead of the supply pressure by valve 212. In this case, returning oil from cylinders 34*a* and 34*b* through line 216 cannot flow unless pressure in line 210 through line 218 pilots open relief valve 220. When the boom attempts to swing ahead of the oil supply, falling pressure in line 210 allows valve 200 to close and the boom swing slow. When the pressure increases in line 210, valve 220 opens, allowing return oil to flow through line 222 and valve 206 to tank. Shifting valve 206 to the left routes oil through line 222, valve 212 and line 216 to the cylinders. Oil returns to tank through valve 212 and line 210 as long as valve 224 is piloted open.

To use the crawler drive system, selector valve 136 is shifted to the right. Pilot oil pressure in lines 138, 140, 158, 180, etc. is relieved to tank thus centering valves 106 and stopping the conveyor drive motor 148. Pilot oil flows through lines 240, 242, 244 and 246 to valves 92 and 102 thus connecting the pump 80 loop to the left track drive motor 252 and the pump 82 loop to the right track drive motor 254. Pump 80 loop oil flows from pump 80 through line 86, line 90, valve 92, and line 258 to motor 252. Oil returns from motor 252 through line 260, valve 92 and line 94 to the pump 80. Relief valves 264 and 266 limit system pressure in the event of an emergency stop. The pump 82 loop circuit is identical. Pilot oil also flows from valve 136 through lines 240, 242, 274, 276 and 278 to release drive motor brakes 280 and 282. Pilot oil also flows from valve 136 through lines 240, 284 and 286 to pump control valves 288 and 290. If the lever on valve 288 is moved to the left, oil flows through line 292 to one of the pump 80 control ports thus stroking the pump in one direction. The pressure from valve 288 and the resulting amount of pump 80 volume is proportional to the amount that the lever on valve 288 is moved from center. If the opposite driving direction is desired, valve 288 may be moved to the right thus diverting oil through line 294 to the opposite pump 80 control port and reversing the pump direction. Control valve 290 directs pump 82 in an identical manner. By operating valves 288 and 290, the operator may direct the track drives together or independently as required.

Referring to the right side of the schematic, when valve 126 is shifted, oil is also directed through lines 296, 298, 300 and 310 to left front floor jack control valve 312. If valve 312 is shifted to the right, oil flows through line 314 to the rod end of cylinder 52*a* and to the check valve in valve 320. Oil flows out of the head end of cylinder 52*a* through the check valve, line 318 and valve 312 back to tank. The cylinder 52*a* will retract. If valve 312 is shifted to the left, oil will flow through valve 312, line 318 and valve 320 to the head end of cylinder 52*a*. The cylinder will extend and oil from the rod end of cylinder 52*a* will flow back to tank through line 314 and valve 312. The right front floor jack assembly consisting of valves 322 and 324 and cylinder 52*b* operates in an identical manner. If the control valves 312 or 322 are not shifted, the cylinder positions are locked by the check valve portions of valves 320 and 324. Overload relief capability is provided in valves 320 and 324 to limit machine loads. If pressure is present in any of the lines 314, 318, 328 or 330, it is routed through a network of shuttle valves 332, 334 and 336 and line 338 to shuttle valve 340 in order to control the rear floor jacks as noted below.

Oil from line 298 may also flow through lines 342 and 344 to valves 346 and 348. If valve 348 is shifted to the right, oil flows through line 350, check valve 352, lines 354, 356 and 358, check valve 360 and line 362 and valves 364 and 366 to extend both the gripper cylinders 58 and the rear floor jacks 54*a* and 54*b* and to pressurize accumulator 368. The mobile mining machine 10 is thus locked in the heading by the opposing jacks and gripper cylinders and the pressure is maintained against check valve 352 by accumulator 368. Pressure overloads are controlled by relief valve 372. The gripper cylinders 58 may be released by shifting valve 348 to the left; thus routing oil through line 374, valve 376 and line 378 to the rod end of the gripper cylinders 58. Oil returns to tank from cylinders 58 through lines 356, 354, valve 352, line 350, and valve 348. Check valve 352 is piloted open by the pressure in line 374 through line 375.

The floor jacks may be raised by shifting valve 346 to the right; oil then flows through line 382, valve 384 and line 386 to the rod end of cylinders 54*a* and 54*b* and to the check valve sections in valves 364 and 366. Also, oil flows through lines 396 and 398 to release check valve 360. Oil can thus flow from the head end of cylinders 54*a* and 54*b* through valves 364 and 366, line 362, valve 360, lines 358 and 356 to the head end of the gripper cylinders 58, extending them. The intended operation of the system is to extend the gripper cylinders 58 and floor jacks 54*a* and 54*b* and lock the machine 10 in the heading as noted above; then, the machine may be steered up or down using valve 346. For example, to steer the machine down, valve 346 is moved to the left. Oil is routed through line 400, valve 376, and line 378 to the rod end of the gripper cylinders 58, thus retracting them. As the gripper cylinders 58 retract, oil from the head end of the gripper cylinders will be transferred to the head end of the floor jacks through lines 356, 358, valve 360, line 362 and valves 364 and 366. Since the floor jack cylinder bodies are tied to the machine, they will also raise but the floor jack pressure will be maintained by the oil from the gripper cylinders. Any excess oil or makeup oil will be supplied by the accumulator 368.

Oil from the rod end of the floor jacks will flow through line 386, valve 384, line 382 and valve 346 to tank. To steer the machine up, valve 346 is moved to the right, oil then flows through line 382, valve 384 and line 386 to the rod ends of rear floor jack cylinders 54*a* and 54*b*. The rear floor jacks retract, lowering the rear end of the machine. Oil from valve 346 flowing through lines 382, 396 and 398 has released valve 360. Oil from line 386 has released valves 364 and 366; thus oil can flow out of the head end of cylinders 54*a* and 54*b* through valves 364 and 366, line 362, valve 360 and lines 358 and 356 to the head end of the gripper cylinders 58, thus extending these cylinders under pressure. Oil from the rod end of these cylinders will then return through line 378, valve 376 and line 374 or 400 and their respective valves 346 or 348 to the tank. The machine 10 can thus be steered while locked in the heading.

As noted previously, if either of the front floor jacks is shifted, oil pressure is routed through shuttle valves 332, 334 and 336 and line 338 to shuttle valve 340. Oil then flows through line 402 to release valves 364 and 366. Oil can then flow from the head end of cylinder 54*a* to the head end of cylinder 54*b*. Check valve 360 restricts the flow out of the cylinders thus maintaining the vertical location of the rear jacks. The effect of this system is to allow roll correction of the mobile mining machine 10 while maintaining rear jack position.

Oil may also flow from pump 128 through valve 126, line 296 and line 404 to valve 406. If valve 406 is shifted to the right, oil will flow through line 408, valve 410 and line 412 to the muck apron lift cylinders 414, thus exending them. Valve 410 maintains cylinder position when valve 406 is centered. Shifting valve 406 to the left routes oil through line 416 to retract cylinders 414 while piloting open valve 410 to allow oil to return to tank from the head ends of cylinders 414.

Oil may also flow through line 418 to valve 420. Shifting valve 420 to the right directs oil through line 422, flow rate control valve 424 and line 426 to the thrust cylinders 40. The cylinders then extend at a rate controlled by valve 424. To retract the cylinders, the valve is shifted to the left thus directing oil to the rod end of cylinders 40, through line 428, and retracting the cylinders.

Oil may flow also through line 430 to valve 432. Shifting valve 432 to the right routes oil through line 434, valve 436 and line 438 to the roof support cylinders 70. Pressure to the cylinders is regulated by pressure reducing valve 436. To retract cylinders 70, valve 432 is shifted to the left, routing oil through line 440 to the rod end of cylinders 70, thus retracting them.

If valve 126 is not shifted, then oil from pump 128 is routed to electric solenoid valve 444. Shifting valve 444 to the right routes oil through line 446 and 448 to the cutterhead inching drive motor 450. Oil also flows through shuttle valve 452 to release the brake 454. Oil returns from the motor 450 through line 456 and valve 444 to tank. Shifting valve 444 to the left reverses the above flow of oil to reverse the cutterhead inching drive direction.

Figure 10:
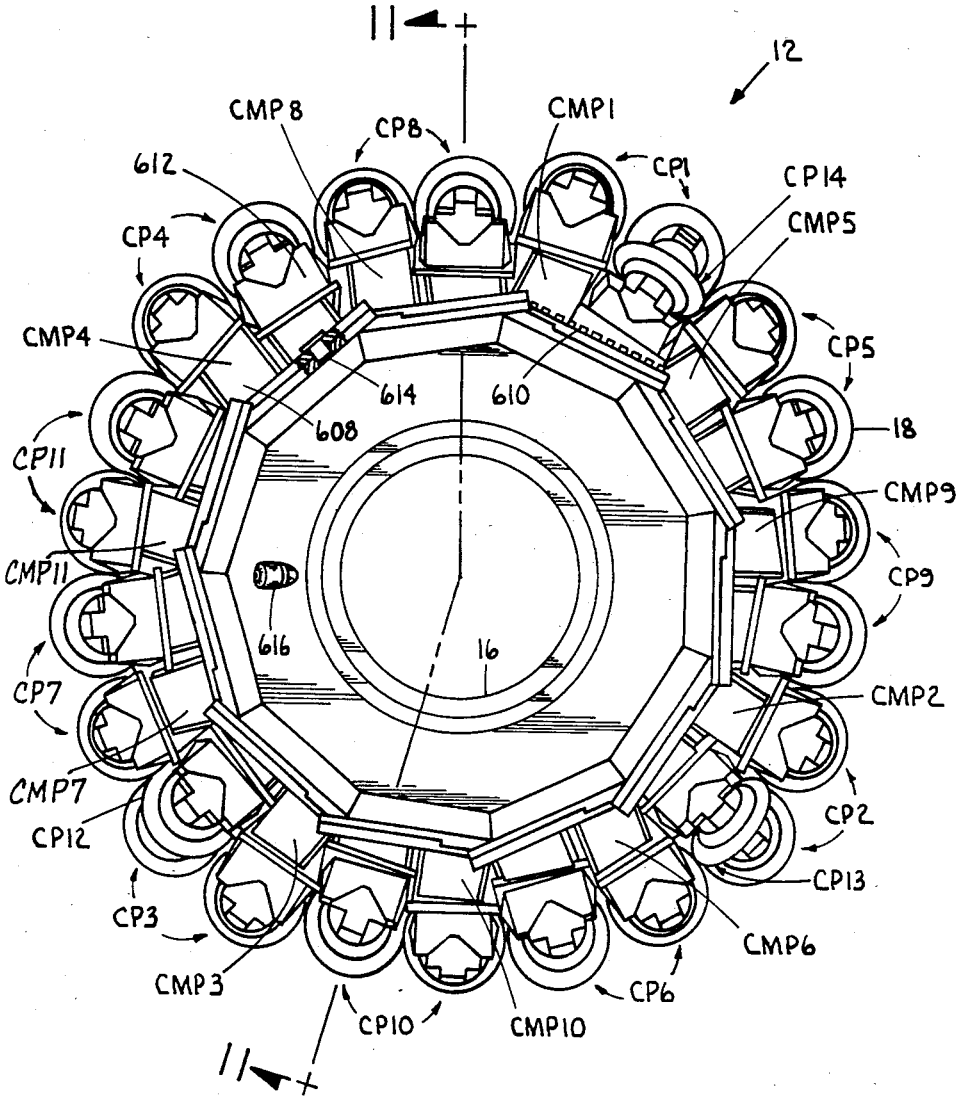
FIG. 10 is a side elevational view of the cutterhead assembly used in the first embodiment.
Figure 11:
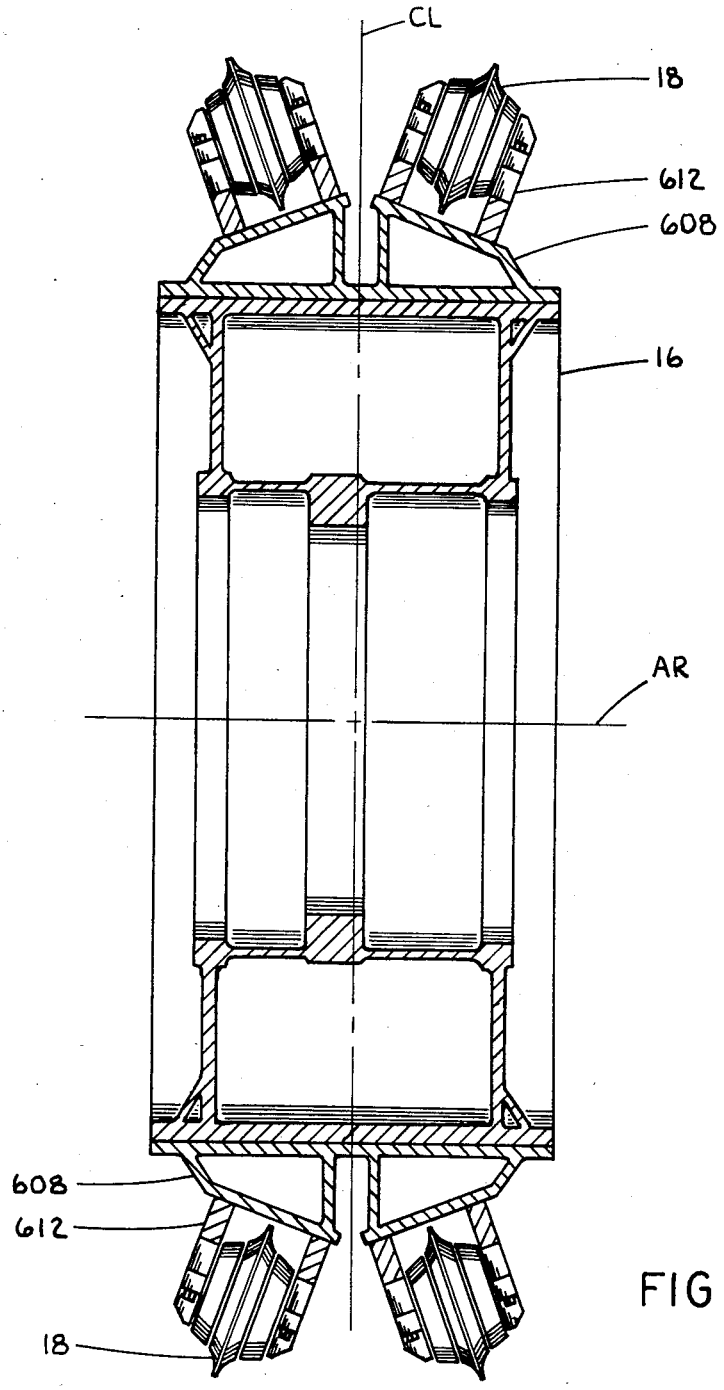
FIG. 11 is a simplified cross-sectional view of the cutterhead assembly taken along line 11—11 in FIG. 10, showing four rolling cutter units in elevation and for simplicity not showing any of the rolling cutter units behind the four which are shown.

As shown in FIG. 10, the cutterhead assembly 12 consists of a drum 16, eleven cutter mounting pads 608, and twenty-eight rolling cutter units 18 and housings 612. The rolling cutter units 18 are bolted into the supporting housings 612 which are welded to the cutter mounting pads 608. The angle and height of the cutter mounting pads 608 establish the location and angular orientation of each cutter 18 as shown in FIG. 11. The mounting pads 608 are secured by bolts 610 to the outer periphery of the central drum 16 as shown in the left hand side view (FIG. 10). Dowel pins 614 are used to locate the cutter pads and also to take some of the loads applied to the cutter pads. FIG. 10 also shows the lube oil drain fitting 616 in drum 16. The drum 16 rotates counterclockwise as shown in FIG. 10 and at the same time is swept from one side of the heading to the other by the boom 20.

Figure 12:
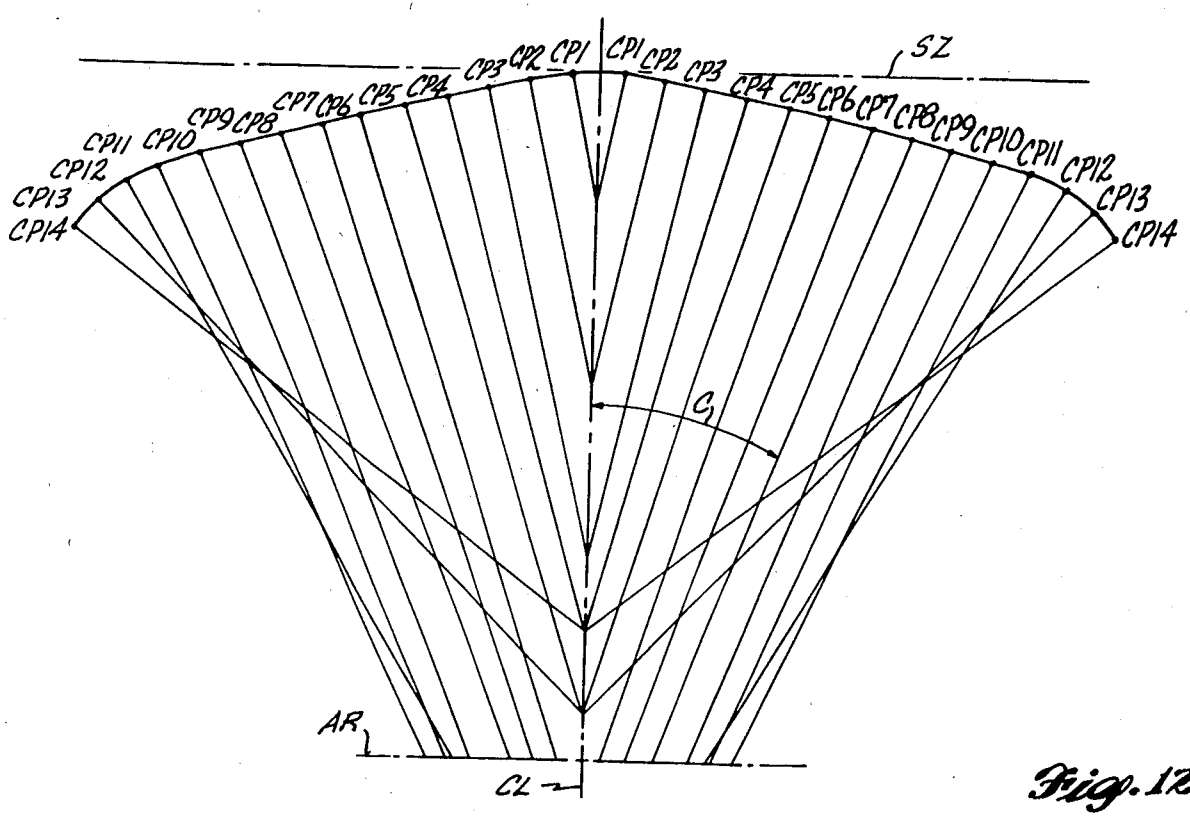
FIG. 12 is a schematic cutter profile of the cutterhead shown in FIG. 10.

The cutter profile drawing FIG. 12 defines the preferred location and angular orientation of the tips of the rolling cutter units 18 on the cutterhead 12. The line CL is the center line of the cutterhead drum, the line AR is the horizontal axis of rotation of the cutterhead assembly, the line SZ is station zero, and the angle C is the cutter angle (the angle between any given cutter and the center line CL). The distance from the line AR to the line SZ is the radius of the cutterhead assembly.

Half of the cutters are arranged on each side of the drum centerline in a symmetrical pattern which allows the cutterhead to cut either when sweeping to the left or to the right. Cutter position numbers (CP1 through CP14) on the profile drawing FIG. 12 correspond to the cutter position numbers (CP1 through CP14) on the cutterhead assembly drawing FIG. 10. Each of the cutter mounting pads 608 provides a base for two of the same numbered face cutters, one from each side of the profile. Thus, cutter mounting pads numbered CMP1 through CMP11 support two face cutters each at cutter position numbers CP1 through CP11. In addition, cutter mounting pads CMP1, CMP2 and CMP3 support two profile cutters at cutter position numbers CP12, CP13 and CP14. Cutters at cutter position numbers CP1 through CP11 cut continuously while cutters at cutter position numbers CP12, CP13, and CP14 cut only at the extremes of the swing.

The novel cutting action may be described as follows. The cutter at cutter position number CP1 cuts rock when it contacts the toroidal-shaped cutting face at the twelve o'clock position. As the cutter descends counterclockwise it will continue to cut until it leaves the face at the six o'clock position. While the cutter is moving down across the cutting face, the cutterhead assembly 12 is traversing to the right or left depending upon the direction of sweep. Thus, each rolling cutter unit 18 describes a substantially helical path down the cutting face as the cutterhead assembly sweeps from side to side. Each of the face cutters follows in order as the cutterhead turns, cracking a crescent-shaped sliver of rock from the face. By the time the cutter at cutter position number CP1 returns to cut the face, the cutterhead assembly has been displaced to the right or left by the boom and so the removal of a new sliver of rock can begin. Depth of cutter penetration and spacing between cuts can be adjusted by adjusting the boom sweep speed; thus the cutting action can be optimized for each type of rock.

Multiple revolutions of the cutterhead as the boom swings will cut away the rock for an entire heading face width. One of the unique aspects of the mobile mining machine 10 is the toroidal-shaped cutting face made in the rock. The cutting face is arcuate in a horizontal plane and arcuate in a vertical plane, hence its toroidal shape.

The sideward sweep rate of the cutterhead assembly 12 may be varied between about 5 to 120 inches per minute, preferably about 10 to 40 inches per minute depending upon the rock conditions. One sweep rate which may be used is about 36 inches per minute. In extremely hard rock, such as abrasive quartzite, a slower sweep rate of about 12 inches per minute may be used. The peripheral velocity of the cutter units 18 at the perimeter of the cutterhead assembly 12 may be varied between about 400 to 800 feet per minute. The cutterhead rotation rate will depend on the radius of the cutterhead assembly and the desired peripheral velocity. The radius of the cutterhead assembly may be from about 36 inches to about 84 inches. For example, if the radius of the cutterhead assembly is 73 inches (a cutterhead diameter of about 12 feet) and if the desired peripheral velocity is 523 feet per minute, then the cutterhead rotation rate would be 13.7 revolutions per minute.

The ratio between the sideward sweep rate and the cutterhead rotation rate expresses or corresponds to the horizontal distance between individual cutter tracks across the work face. The ratio may be varied between about 1.25 to 4.5 inches per revolution to achieve the most efficient cracking of the hard rock. Below about 1.25 inches per revolution, the hard rock may be crushed too finely for most efficient operation. Thus, for example, the ratio of 2.625 inches per revolution may be a desirable ratio for certain hard rocks. If the radius of the cutterhead assembly is 73 inches and if the cutterhead rotation rate is 13.7 revolutions per minute, then a sideward sweep rate of 36 inches per minute will produce a ratio of 2.625 inches per revolution. As described above, the plunge depth for each plunge of the rotating cutterhead assembly may be a distance of about 0.1 to 4 inches and the plunge rate may be about 1 to 10 inches per minute depending on the rock conditions.

The Second Embodiment

Referring to FIGS. 6–9, the second embodiment of the invention is the mobile mining machine 500 which includes a horizontally swinging and vertically ranging wheel-like cutterhead assembly 502 mounted on a crawler and base frame assembly 504. This machine is capable of mining large variable cross section tunnels in hard rock conditions with a minimum of preparation. Compared to the mobile mining machine 10 shown in FIG. 1, the mobile mining machine 500 is smaller and lighter in weight, yet by virtue of the vertical ranging cutterhead, it can cut a mining tunnel which is actually larger than the tunnel cut by the mobile mining machine 10.

Figure 6:
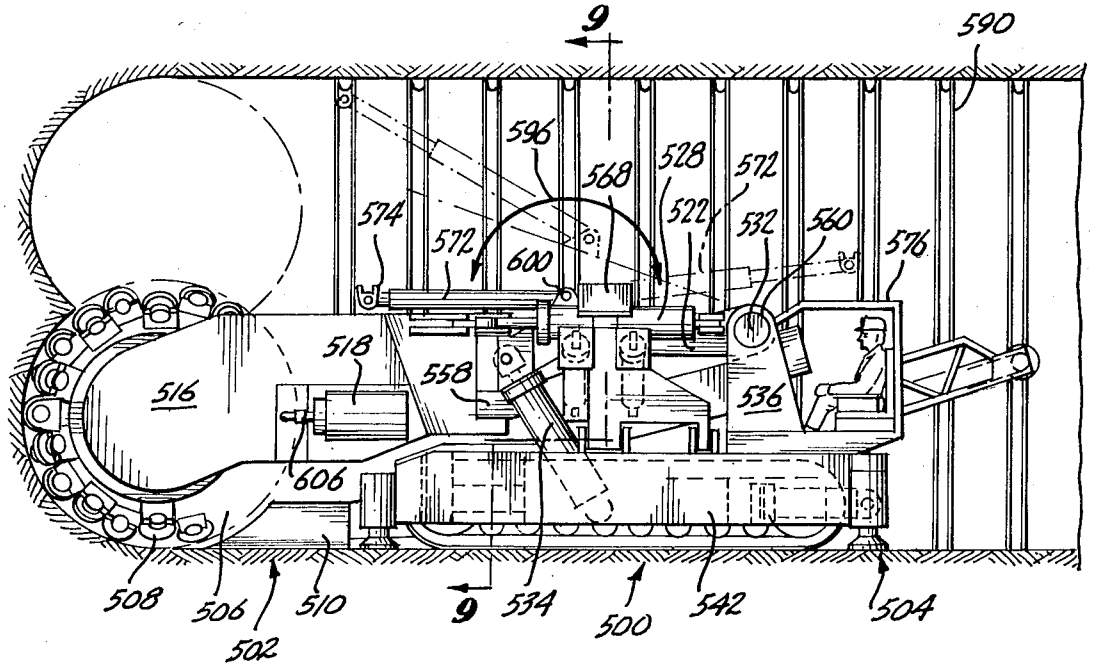
FIG. 6 is a side elevational view of a second embodiment of a mobile mining machine constructed in accordance with the principles of the present invention.
Figure 7:
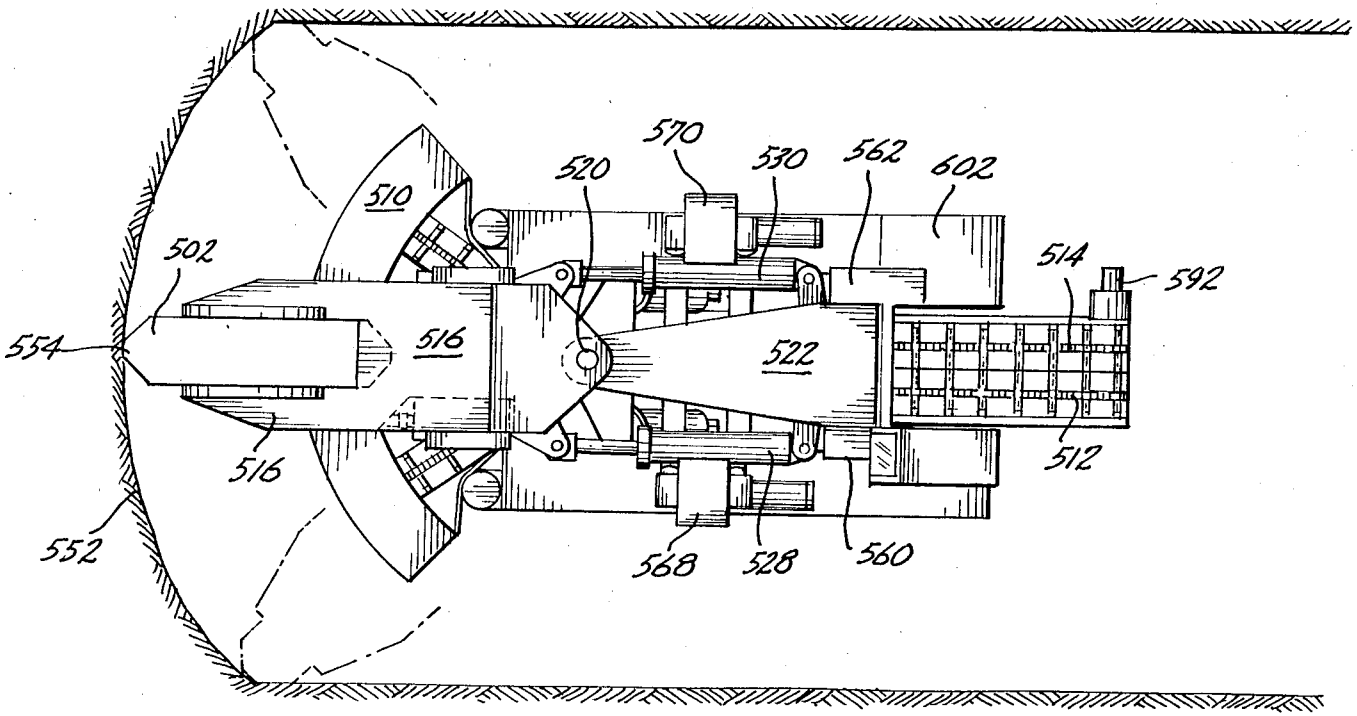
FIG. 7 is a top view of the mobile mining machine illustrated in FIG. 6.

The cutterhead assembly 502 (FIG. 6) consists of a transverse horizontal axis wheel-like drum 506 on which are peripherally mounted a plurality of rolling cutter units 508. These are preferably hard rock rolling disc cutters about 10 to 18 inches in diameter of the general type disclosed in Sugden U.S. Pat. No. 3,787,101, issued Jan. 22, 1974. Alternatively, the rolling cutter units 508 may be rolling button cutters of the general type disclosed in Sugden U.S. Pat. No. 4,381,038 issued Apr. 26, 1983. The cutterhead cuts the profile by plunging forward into the rock and then sweeping left or right and up or down in order to achieve the tunnel outline. Paddles on the cutterhead sweep the cuttings up and over the muck apron 510 and onto the muck conveyors 512 and 514 (FIG. 7). The details of the cutterhead assembly 502 may be similar to the cutterhead assembly 12 shown in FIG. 10.

The cutterhead assembly 502 is mounted between the two arms of the outer boom assembly 516. Final gearing inside the cutterhead is driven by two 150 kW (200 H.P.) water-cooled electric motors 518 mounted on each side of the outer boom 516. These motors drive the cutterhead 502 through corresponding drive shafts, the left one of which is indicated at 606. Drive is through a right angle gear box (not shown) situated generally centrally of the drum 506. There is also a planetary gearing system within the cutterhead. Both motor driven shafts drive the cutterhead by a gang drive arrangement.

The outer boom 516 swings horizontally from side to side on a vertical pivot indicated at 520 (FIG. 7) at the outer end of the inner boom 522.

The inner boom assembly 522 (FIG. 6) supports the vertical pivot 520 for the outer boom 516 and the swing cylinders 528 and 530 that position the outer boom. The lower arm 558 of the inner boom 522 supports the lower part of the trunnion assembly providing the vertical pivot axis 520. The inner boom is supported at its inner end by a horizontal pivot indicated at 532 (FIG. 6). The horizontal pivot 532 is provided by the trunnions 560 and 562 (FIG. 7). The boom carriage 536 supports the trunnions 560 and 562. The lift cylinders **534*a* and 534*b* can thus lift the inner boom 522, the outer boom 516, and the cutterhead 502 as required for vertical articulation. The left lift cylinder 534*a* is shown in FIG. 6 and the right lift cylinder 534*b* is shown in FIG. 7**.

Swing cylinders 528 and 530 are provided for horizontally swinging the outer boom 516 and the cutterhead 502. As shown in FIG. 7, the rear portions of the swing cylinders 528 and 530 are mounted on the sides of the inner boom 522 and the front portions of the cylinder rods are mounted on the rear side portions of the outer boom 516.

The boom carriage 536 (FIG. 6) supports the horizontal pivot 532 for the inner boom 522 and carries the thrust force from the thrust cylinders 538 (FIG. 8) to the cutterhead 502. The frame of the boom carriage 536 extends far forward and also anchors the lift cylinders **534*a* and 534*b*. The boom carriage 536 is mounted on bronze bearings which slide on the cylindrical guide tubes 540 (FIG. 8) supported by the crawler frame 542. The twin chain conveyors 512, 514 pass from the muck apron 510 through the center of the boom carriage 536 and out the rear. It is possible to use a single conveyor rather than a double conveyor. The conveyor drive motor 592 is shown in FIG. 7**.

The crawler frame 542 mounts the cylindrical guide tubes 540 (FIGS. 8 and 9) which in turn support the boom carriage 536. The crawler frame is supported by the four floor jacks **544*a*, 544*b*, 546*a*, 546*b* during mining or by the crawler tracks 548***a* and 548*b* during tramming or regrip. As shown in FIG. 9, the crawler frame 542 surrounds the crawler tracks 548*a* and 548*b*. The crawler frame 542 consists of the two box sections on the sides that contain the tracks 548*a* and 548*b*, the bridge beam 586 in the middle of the machine, and the cross beam 594 (FIG. 8) at the rear. The gripper cylinders 550*a* and 550*b* are also mounted on the crawler frame 542 for stability in hard rock mining. The side gripper pads are indicated at 568 and 570.

With particular reference to FIG. 9 for further detail, the left gripper pad 568 is actuated by the left hydraulic gripper cylinder 550*a* which is in turn swung out by the action of the two left swing-out cylinders 590*a* which swing the gripper cylinder 550*a* and gripper pad 568 down and out from the dotted line position shown, following which the extension of the gripper cylinder 550*a* causes the gripper pad 568 to grip the tunnel left side wall. The two left swing-out cylinders 590*a* are also shown in FIGS. 6 and 7.

Similarly, the right gripper pad 570 is actuated by the right hydraulic gripper cylinder 550*b* which is in turn swung out by action of the two right swing-out cylinders 590*b* which swing the gripper cylinder 550*b* and gripper pad 570 down and out from the dotted line position shown (FIG. 9), following which the extension of the gripper cylinder 550*b* causes the gripper pad 570 to grip the tunnel right side wall. The two right swing-out cylinders 590*b* are also shown in FIG. 7.

FIG. 9 also shows a cross-section of the inner boom 522. The main beam 584 is shown in cross-section and it houses the conveyors 512 and 514. The bridge beam 586 goes across from one track housing to the other. The swing cylinders 528 and 530 are also shown in cross-section in FIG. 9. Guide tubes 540 are also shown in cross-section in FIG. 9. During operation, the thrust cylinders 538 (FIG. 8) thrust the machine forwardly on the guide tubes 540.

The operator's cab is indicated at 576 (FIG. 6). The conventional electrical system includes the operator's console 578 located in the cab. In other details, the operator's cab 576 may be similar to the operator's cab 46 described above with respect to the first embodiment.

The hydraulic power pack for the machine is indicated in FIG. 7 at 602.

The beam erector cylinders indicated at 572 (FIG. 6) have at the ends thereof U-shaped beam supports 574. Not shown is the arrangement of beam erectors which involves two of them spread apart a distance less than the width of the tunnel to give each ring beam 598 stability as it is lifted into place. These are about 60° apart with respect to the center of curvature of the ring beam 598.

The erector assembly swings through an arc of almost 180° as shown by the arrow designated 596 (FIG. 6), the rearmost position of the beam erector cylinder 572 being indicated in FIG. 6 at 572*r*. The swinging of the beam erector assembly (including cylinder 572) is by the rotary actuator 600 which is in turn driven by a hydraulic motor. By definition, a rotary actuator is a hydraulic motor which rotates an element only 180°.

Figure 8:
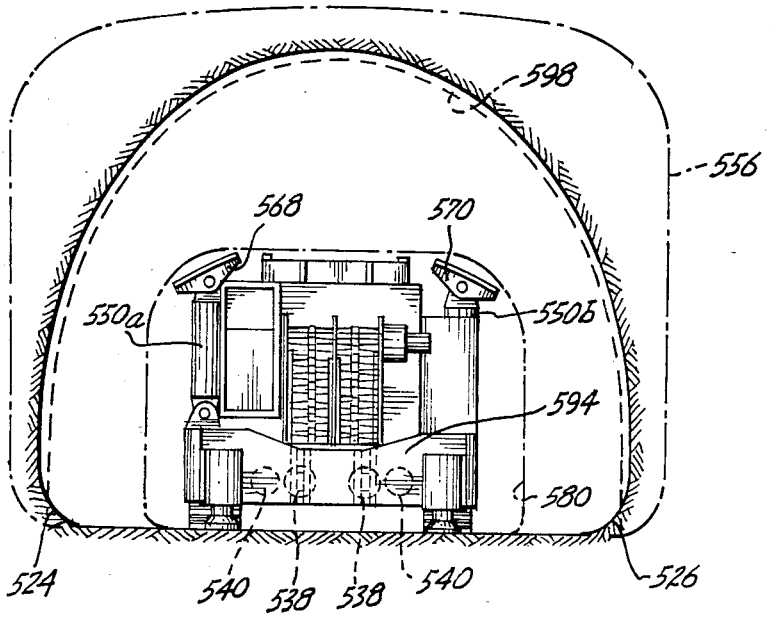
FIG. 8 is a rear view of the mobile mining machine illustrated in FIG. 6.
Figure 9:
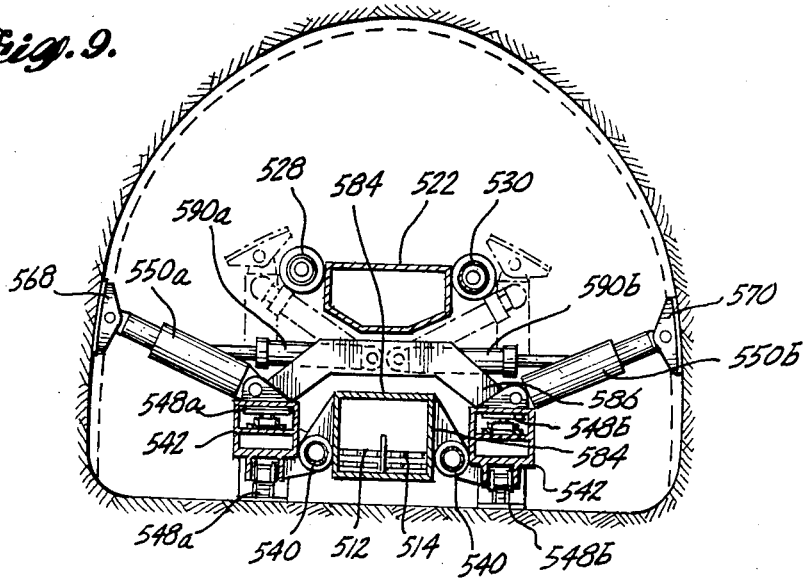
FIG. 9 is a cross-sectional view of the second embodiment taken substantially along line 9—9 in FIG. 6.

FIG. 8 shows the minimum profile designated as broken line 580. FIG. 8 also shows what happens when the boom and cutterhead are swung from side to side to the maximum extent and then lifted vertically and swung from side to side to the maximum extent. The result is the maximum profile designated as broken line 556 which is basically a rectangular shape with rounded corners. The lower left corner is designated as 524 and the lower right corner is designated as 526. The goal is to either make a flat bottom or to minimize the amount of rock that has to be chipped out of the lower corners 524 and 526 (for example, by means such as a jackhammer) to make the flat platform for the ring beams 598. The ring beams 598 have no support in between them except some wire mesh or other light lining. They are assembled from three or four segments to make up each beam. The standard insofar as beam parts is use of three parts but use of four parts is possible.

FIG. 6 shows the cutterhead assembly 502 in side elevation. The details of the cutterhead assembly 502 may be similar to that shown in FIG. 10. The array of cutters, considered axially of the cutterhead, covers a wide curving profile which may vary. In general, the sharper the curvature, the smaller the corner at the side of the bottom will be.

To start a tunnel, the operator crawls the machine 500 up to the rock face 552 (FIG. 7) until the cutterhead 502 just touches the rock face midpoint 554. The floor jacks are then extended to elevate the machine to grade as determined by a laser. The onboard mini-computer is input with machine position and the cutterhead 502 is advanced a small amount into the rock. The operator then energizes the start sequence and the cutterhead 502 cuts any of several preprogrammed profile shapes, for example, the dome-shaped profile shown in FIG. 9 which is designed to receive the ring beams 598. The computer controls the boom movement during the cutting cycle in response to linear transducers which measure the excursion of the boom in the horizontal axis and the vertical axis. Alternatively, manual controls may be used.

After the cutting cycle is complete, the operator advances the machine 500 into the rock and again presses the start button. After completing a series of cutting cycles and reaching the end of a thrust stroke, the operator raises the floor jacks, crawls forward a short distance (e.g., 75 cm) and extends the jacks to begin a new series of cutting cycles. After the machine has advanced approximately 7 meters into a new rock face, the grippers 530*a* and 550*b* are extended for drilling support.

The hydraulic control system for the mobile mining machine 500 may be similar in principle to the hydraulic control system of the mobile mining machine 10 shown in the simplified schematic representation of FIGS. 5A, 5B, and 5C.

The cutter profile of the mobile mining machine 500 may be similar in principle to the cutter profile of the mobile mining machine 10 shown in FIG. 12.

The above-described embodiments are intended to be illustrative, not restrictive. The full scope of the invention is defined by the claims, and any and all equivalents are intended to be embraced.

What is claimed is:

1. A method of cutting a tunnel in hard rock, comprising the steps of:

(a) providing a wheel-like cutterhead assembly means for cutting said hard rock, said cutterhead assembly means having a substantially horizontal axis of rotation and having multiple peripherally mounted rolling cutter units each rotatable about its own axis, said cutterhead assembly means being supported by boom means, said boom means being supported by frame means;

(b) anchoring said frame means within the interior of said tunnel;

(c) while rotating said cutterhead assembly means about its substantially horizontal axis, plunging said rotating cutterhead assembly means forwardly into the hard rock work face;

(d) while rotating said cutterhead assembly means about its substantially horizontal axis, sweeping said rotating cutterhead assembly across said hard rock work face, the rolling cutter units on the cutterhead assembly means being rotated about their respective axes by contact with the work face and making substantially helical cuts in the work face in the course of transiting the work face, such sweeping action and cutterhead assembly means rotation continuing until the cutterhead assembly means has transited completely across the work face;

(e) while rotating said cutterhead assembly means about its horizontal axis, plunging the rotating cutterhead assembly means forwardly into the hard rock work face;

(f) while rotating said cutterhead assembly means about its substantially horizontal axis, sweeping said rotating cutterhead assembly means back across the hard rock work face, such sweeping action and cutterhead assembly means rotation continuing until the rotating cutterhead assembly means has transited completely across the hard rock work face; and (g) repeating steps (c), (d), (e), and (f) above.

2. The method of claim 1, wherein said cutterhead assembly means is rotated at a selected rotation rate to give a peripheral velocity of about 400 to 800 feet per minute.

3. The method of claim 1, wherein said rotating cutterhead assembly means is plunged forwardly into said hard rock work face until the plunge depth is about 0.1 to 4 inches.

4. The method of claim 2, wherein said cutterhead assembly means has a radius of about 36 to 84 inches.

5. The method of claim 3, wherein said cutterhead assembly means has a radius of about 36 to 84 inches, and each rolling cutter unit is a disc cutter having a diameter of about 10 to 18 inches.

6. The method of claim 2, comprising sweeping the cutterhead assembly horizontally in steps (d) and (f).

7. The method of claim 3, comprising sweeping the cutterhead assembly in steps (d) and (e).

8. A method of cutting a mining tunnel in hard rock, comprising the steps of:

(a) providing a wheel-like cutterhead assembly means for cutting said hard rock, said cutterhead assembly means having a horizontal axis of rotation and having multiple peripherally mounted disc-like cutter units each rotatable about its own axis, said cutterhead assembly means being supported by boom means, said boom means being supported by frame means, said frame means having holding means mounted thereon for anchoring said frame means within said tunnel;

(b) extending said holding means against the interior of said tunnel to anchor said frame means within said tunnel;

(c) rotating said cutterhead assembly means about its horizontal axis at a selected rotation rate to give a selected peripheral velocity;

(d) plunging said rotating cutterhead assembly means forward into said hard rock until a selected plunge depth is achieved;

(e) sweeping said rotating cutterhead assembly means sideward in a first horizontal direction against said hard rock at a selected sweep rate until a selected width of cut is achieved (f) plunging said rotating cutterhead assembly means forward into said hard rock until a selected plunge depth is achieved;

(g) sweeping said rotating cutterhead assembly means sideward in the other horizontal direction against said hard rock at a selected sweep rate until a selected width of cut is achieved; and (h) then repeating steps (d), (e), (f), and (g).

9. The method of claim 8 wherein said peripheral velocity is between about 400 to 800 feet per minute.

10. The method of claim 8 wherein said plunge depth is between about 0.1 to 4 inches.

11. The method of claim 8 wherein said sweep rate is between about 5 to 120 inches per minute.

12. The method of claim 8 wherein the ratio between the sweep rate and the cutterhead rotation rate is between about 1.25 to 4.5 inches per revolution.

13. A method of cutting a mining tunnel in hard rock, comprising the steps of:

(a) providing a wheel-like cutterhead assembly means for cutting said hard rock, said cutterhead assembly means having a horizontal axis of rotation and having multiple peripherally mounted disc-like cutter units each rotatable about its own axis, said cutterhead assembly means being supported by boom means, said boom means being supported by frame means, said frame means having holding means mounted thereon for anchoring said frame means within said tunnel;

(b) extending said holding means against the roof and floor of said tunnel to anchor said frame means within said tunnel;

(c) rotating said cutterhead assembly means about its horizontal axis at a selected rotation rate to give a peripheral velocity between about 400 to 800 feet per minute;

(d) plunging said rotating cutterhead assembly means forward into said hard rock until a plunge depth between about 0.1 to 4 inches is achieved;

(e) sweeping said rotating cutterhead assembly means sideward in a first horizontal direction through said hard rock at a sweep rate between about 5 to 120 inches per minute wherein the ratio between the sweep rate and the cutterhead rotation rate is between about 1.25 to 4.5 inches per revolution, until a selected width of cut is reached;

(f) plunging said rotating cutterhead assembly means forward into said hard rock until a plunge depth between about 0.1 to 4 inches is achieved;

(g) sweeping said rotating cutterhead assembly means sideward in the other horizontal direction through said hard rock at a sweep rate between about 5 to 120 inches per minute wherein the ratio between the sweep rate and the cutterhead rotation rate is between about 1.25 to 4.25 inches per revolution, until a selected cut of width is achieved; and (h) then repeating steps (d), (e), (f), and (g).

14. A method of cutting a tunnel in hard rock, comprising the steps of:

(a) providing a wheel-like cutterhead assembly means for cutting said hard rock, said cutterhead assembly means having a substantially horizontal axis of rotation and having multiple peripherally mounted rolling cutter units each rotatable about its own axis, said cutterhead assembly means being supported by frame means, said frame means having holding means mounted thereon for anchoring said frame means within said tunnel;

(b) extending said holding means against the interior of said tunnel to anchor said frame means within said tunnel;

(c) while rotating said cutterhead assembly means about its horizontal axis, plunging said rotating cutterhead assembly means forwardly into the hard rock work face;

(d) while rotating said cutterhead assembly means about its substantially horizontal axis, sweeping said rotating cutterhead assembly across said hard rock work face, the rolling cutter units on the cutterhead assembly means being rotated about their respective axes by contact with the work face and making a substantially helical cut in the work face in the course of transiting the work face, such sweeping action and cutterhead assembly means rotation continuing until the cutterhead assembly means has transited completely across the work face;

(e) while rotating said cutterhead assembly means about its horizontal axis, plunging the rotating cutterhead assembly means forwardly into the hard rock work face;

(f) stopping the rotation of said cutterhead assembly means and then rotating said cutterhead assembly means in the reverse direction of rotation;

(g) while rotating said cutterhead assembly means about its substantially horizontal axis, sweeping said rotating cutterhead assembly means back across the hard rock work face, such sweeping action and cutterhead assembly means rotation continuing until the rotating cutterhead assembly means has transited completely across the hard rock work face; and (h) repeating steps (e), (f), and (g) above.

15. The method of claim 14, wherein said cutterhead assembly means is rotated at a selected rotation rate to give a peripheral velocity of about 400 to 800 feet per minute.

16. The method of claim 14, wherein said rotating cutterhead assembly means is plunged forwardly into said hard rock work face until the plunge depth is about 0.1 to 4 inches.

17. The method of claim 15, wherein said cutterhead assembly means has a radius of about 36 to 84 inches.

18. The method of claim 16, wherein said cutterhead assembly has a radius of about 36 to 84 inches, and each rolling disc-like cutter unit is a disc cutter having a diameter of about 10 to 18 inches.

19. The method of claim 15, comprising sweeping the cutterhead assembly horizontally in steps (d) and (g).

20. The method of claim 16, comprising sweeping the cutterhead assembly horizontally in steps (d) and (g).

21. A method of cutting a mining tunnel in hard rock, comprising the steps of:

(a) providing a wheel-like cutterhead assembly means for cutting said hard rock, said cutterhead assembly means having a horizontal axis of rotation and having multiple peripherally mounted disc-like cutter units each rotatable about its own axis, said cutterhead assembly means being supported by boom means, said boom means being supported by frame means, said frame means having holding means mounted thereon for anchoring said frame means within said tunnel;

(b) extending said holding means against the roof and floor of said tunnel to anchor said frame means in place within said tunnel;

(c) rotating said cutterhead assembly means about its horizontal axis at a selected rotation rate to give a selected peripheral velocity;

(d) plunging said rotating cutterhead assembly means forward into said hard rock until a selected plunge depth is achieved;

(e) sweeping said rotating cutterhead assembly means sideward in a first horizontal direction through said hard rock at a selected sweep rate until a selected width of cut is achieved;

(f) plunging said rotating cutterhead assembly means forward into said hard rock until a selected plunge depth is achieved;

(g) stopping the rotation of said cutterhead assembly means and then rotating said cutterhead assembly means in the reverse direction of rotation;

(h) sweeping said rotating cutterhead assembly means sideward in the other horizontal direction through said hard rock at a selected sweep rate until a selected width of cut is achieved; and (i) then repeating steps (f), (g), and (h).

22. The method of claim 21 wherein said peripheral velocity is between about 400 to 800 feet per minute.

23. The method of claim 21 wherein said plunge depth is between about 0.1 to 4 inches.

24. The method of claim 21 wherein said sweep rate is between about 5 to 120 inches per minute.

25. The method of claim 21 wherein the ratio between the sweep rate and the cutterhead rotation rate is between about 1.25 to 4.5 inches per revolution.

26. A method of cutting mining tunnels in hard rock, comprising the steps of:

(a) providing a wheel-like cutterhead assembly means for cutting said hard rock, said cutterhead assembly means having a horizontal axis of rotation and having multiple peripherally mounted disc-like cutter units each rotatable about its own axis, said cutterhead assembly means being supported by boom means, said boom means being supported by frame means, said frame means having holding means mounted thereon for anchoring said frame means within said tunnel;

(b) extending said holding means against the roof and floor of said tunnel to anchor said frame means within said tunnel;

(c) rotating said cutterhead assembly means about its horizontal axis at a selected rotation rate to give a peripheral velocity between about 400 to 800 feet (120 to 240 meters) per minute;

(d) plunging said rotating cutterhead assembly means forward into said hard rock until a plunge depth between about 0.1 to 4 inches is achieved;

(e) sweeping said rotating cutterhead assembly means sideward in a first horizontal direction through said hard rock at a sweep rate between about 5 to 120 inches per minute wherein the ratio between the sweep rate and the cutterhead rotation rate is between about 1.25 to 4.5 inches per revolution, until a selected width of cut is reached;

(f) plunging said rotating cutterhead assembly means forward into said hard rock until a plunge depth between about 0.1 to 4 inches is achieved;

(g) stopping the rotation of said cutterhead assembly means and then rotating said cutterhead assembly means in the reverse direction;

(h) sweeping said rotating cutterhead assembly means sideward in the other horizontal direction through said hard rock at a sweep rate between about 5 to 120 inches per minute wherein the ratio between the sweep rate and the cutterhead rotation rate is between about 1.25 to 4.25 inches per revolution, until a selected cut of width is achieved; and (i) then repeating steps (f), (g), and (h).

27. A mobile mining machine for cutting a mining tunnel in hard rock by horizontal sweeping movements, comprising:

(a) a wheel-like cutterhead assembly means for cutting said hard rock, said cutterhead assembly means having a substantially horizontal axis of rotation and having multiple peripherally mounted rolling cutter units;

(b) rotation means for rotating said cutterhead assembly means about its horizontal axis;

(c) boom assembly means for supporting said cutterhead assembly means;

(d) boom carriage means for supporting said boom assembly means;

(e) sweep means mounted on said boom carriage means for sweeping said boom assembly means and said cutterhead assembly means horizontally from side to side;

(f) base frame means for slidably supporting said boom carriage means;

(g) thrust means mounted on said base frame means for thrusting forward said boom carriage means, said boom assembly means, and said cutterhead assembly;

(h) holding means for holding said base frame means stationary when said thrust means is thrusting forward said boom carriage means and when said sweep means is sweeping said cutterhead assembly means from side to side, said holding means being mounted on said base frame means, said holding means being capable of acting against the interior of said tunnel whereby said base frame means may be anchored within said tunnel; and (i) transport means for transporting said base frame means.

28. The mobile mining machine of claim 27 further comprising:

muck removal means for removng cut rock from said cutterhead assembly means.

29. The mobile mining machine of claim 28 wherein said muck removal means further comprises a muck apron means and conveyor means for conveying the cut rock away from said cutterhead assembly means.

30. The mobile mining machine of claim 27 wherein said rolling cutter units are disc cutters about 10 to 18 inches in diameter which are arranged on said cutterhead assembly means so that one-half of the disc cutters are located on each side of the cutterhead centerline in a synmetrical pattern and so that the cutter profile defined by the angular orientation of the tips of the disc cutters is generally in the shape of an inverted V.

31. The mobile mining machine of claim 27 wherein said sweep means mounted on said boom carriage means comprises hydraulic cylinder means mounted on said boom carriage means.

32. The mobile mining machine of claim 27 wherein said thrust means mounted on said base frame means comprises hydraulic cylinder means mounted on said base frame means.

33. The mobile mining machine of claim 27 wherein said holding means mounted on said base frame means comprises: (a) hydraulic gripper cylinder means, said gripper cylinder means being capable of acting against the roof of said tunnel; and (b) hydraulic floor jack means, said floor jack means being capable of acting against the floor or said tunnel.

34. The mobile mining machine of claim 27 wherein said transport means for transporting said base frame means comprises crawler means mounted on said base frame means.

35. The mobile mining machine of claim 27 additionally comprising roof support means mounted on said boom carriage means.

36. A mobile mining machine for cutting a mining tunnel in hard rock by horizontal sweeping movements and vertical ranging movements, comprising:

(a) a wheel-like cutterhead assembly means for cutting said hard rock, said cutterhead assembly means having a substantially horizontal axis of rotation and having multiple peripherally mounted rolling cutter units;

(b) rotation means for rotating said cutterhead assembly means about its horizontal axis;

(c) outer boom assembly means for supporting said cutterhead assembly means;

(d) inner boom assembly means for supporting said outer boom assembly means;

(e) sweep means mounted on said inner boom assembly means for sweeping said outer boom assembly means and said cutterhead assembly means horizontally from side to side;

(f) boom carriage means for supporting said inner boom assembly means;

(g) lift means mounted on said boom carriage means for vertically lifting said inner boom assembly means, said outer boom assembly, and said cutterhead assembly;

(h) base frame means for slidably supporting said boom carriage means;

(i) thrust means mounted on said base frame means for thrusting forward said boom carriage means, said inner boom assembly, said outer boom assembly, and said cutterhead assembly;

(j) holding means for holding said base frame means stationary when said thrusting means is thrusting said forward boom carriage means and when said sweep means is sweeping said cutterhead assembly means from side to side, said holding means being mounted on said base frame means, said holding means being capable of acting against the interior of said tunnel whereby said base frame means may be anchored within said tunnel; and (k) transport means for transporting said base frame means.

37. The mobile mining machine of claim 36, further comprising:

muck removal means for removing cut rock from said cutterhead assembly means.

38. The mobile mining machine of claim 37 wherein said muck removal means comprises muck apron means and conveyor means for removing cut rock from said cutterhead assembly means.

39. The mobile mining machine of claim 36, wherein said rolling cutter units are disc cutters about 10 to 18 inches in diameter which are arranged on said cutterhead assembly means so that one-half of the disc cutters are located on each side of the cutterhead center line in a symmetrical pattern and so that the cutter profile defined by the angular orientation of the tips of the disc cutters is generally in the shape of an inverted V.

40. The mobile mining machine of claim 36, wherein said sweep means mounted on said inner boom assembly means comprises hydraulic cylinder means.

41. The mobile mining machine of claim 36, wherein said lift means mounted on said boom carriage means comprises hydraulic cylinder means for lifting vertically said inner boom assembly means.

42. The mobile mining machine of claim 36, wherein said thrust means mounted on said base frame means comprises hydraulic cylinder means mounted on said base frame means for thrusting forward said boom carriage means.

43. The mobile mining machine of claim 36 wherein said holding means mounted on said base frame means comprises hydraulic gripper cylinder means, said gripper cylinder means being capable of acting against the sides of said tunnel.

44. The mobile mining machine of claim 36 wherein said transport means for transporting said base frame means comprises crawler means mounted on said base frame means.

45. The mobile mining machine of claim 36 additionally comprising beam erector means mounted on said inner boom assembly means.

* * * * *